US011802740B2

(12) United States Patent
Machida

(10) Patent No.: US 11,802,740 B2
(45) Date of Patent: Oct. 31, 2023

(54) LOOP HEAT PIPE WITH REINFORCING MEMBER

(71) Applicant: SHINKO ELECTRIC INDUSTRIES CO., LTD., Nagano (JP)

(72) Inventor: Yoshihiro Machida, Nagano (JP)

(73) Assignee: SHINKO ELECTRIC INDUSTRIES CO., LTD., Tokyo (JP)

( * ) Notice: Subject to any disclaimer, the term of this patent is extended or adjusted under 35 U.S.C. 154(b) by 17 days.

(21) Appl. No.: 17/408,875

(22) Filed: Aug. 23, 2021

(65) Prior Publication Data

US 2022/0065551 A1 Mar. 3, 2022

(30) Foreign Application Priority Data

Aug. 27, 2020 (JP) ..... 2020-143541

(51) Int. Cl.
*F28D 15/00* (2006.01)
*F28D 15/04* (2006.01)

(52) U.S. Cl.
CPC ..... *F28D 15/043* (2013.01)

(58) Field of Classification Search
CPC ..... F28D 15/043; F28D 15/0266; F28D 15/0275; F28D 15/0233; F28D 2015/0225; F28F 2225/00
See application file for complete search history.

(56) References Cited

U.S. PATENT DOCUMENTS

2010/0243212 A1* 9/2010 Meyer, IV ..... F28D 15/04 165/104.26
2014/0168896 A1* 6/2014 Fujiwara ..... H05K 7/20 361/699
2016/0259383 A1 9/2016 Shioga et al.
2018/0252483 A1* 9/2018 Geng ..... H01L 23/3672
2019/0003775 A1* 1/2019 Lin ..... H01L 23/4006
2020/0025463 A1 1/2020 Kurashima

FOREIGN PATENT DOCUMENTS

| | | |
|---|---|---|
| EP | 3 477 237 | 5/2019 |
| EP | 3 611 456 | 2/2020 |
| EP | 3 628 956 | 4/2020 |
| EP | 3 644 001 | 4/2020 |
| JP | 6146484 | 6/2017 |

OTHER PUBLICATIONS

European Search Report dated Jan. 24, 2022, 5 pages.

* cited by examiner

*Primary Examiner* — Travis Ruby
(74) *Attorney, Agent, or Firm* — Rankin, Hill & Clark LLP

(57) ABSTRACT

A loop heat pipe includes: an evaporator configured to vaporize a working fluid; a condenser configured to condense the working fluid; a liquid pipe that connects the evaporator and the condenser to each other; and a vapor pipe that connects the evaporator and the condenser to each other. Each of the evaporator, the condenser, the liquid pipe and the vapor pipe includes: a pair of outer metal layers; an intermediate metal layer provided between the pair of outer metal layers; and a flow channel defined by the pair of outer metal layers and the intermediate metal layer. At least one of the evaporator, the condenser, the liquid pipe and the vapor pipe further includes a reinforcing member that is built in at least one of the pair of outer metal layers and that is higher in rigidity than the pair of outer metal layers.

11 Claims, 13 Drawing Sheets

LOOP HEAT PIPE WITH REINFORCING MEMBER

This application claims priority from Japanese Patent Applications No. 2020-143541, filed on Aug. 27, 2020, the entire contents of which are herein incorporated by reference.

BACKGROUND

Technical Field

The present disclosure relates to a loop heat pipe.

Background Art

In the background art, a heat pipe that transports heat using a phase change of a working fluid has been proposed as a device for cooling a heating component of a semiconductor device (such as a CPU) mounted on an electronic apparatus (e.g. Japan Patent No. 6146484).

As an example of such a heat pipe, there has been known a loop heat pipe including an evaporator that vaporizes a working fluid by heat of a heating component, and a condenser that cools and liquefies the vaporized working fluid, wherein: the evaporator and the condenser are connected to each other through a liquid pipe and a vapor pipe, that form a loop-like flow channel. The loop heat pipe has a loop structure in which the evaporator, the vapor pipe, the condenser, and the liquid pipe are connected in series, and the working fluid is sealed inside the loop heat pipe.

By the way, when the working fluid in a liquid phase is vaporized, volume expansion may occur in the loop heat pipe in accordance with characteristics of the working fluid sealed inside the loop heat pipe. Further, when an ambient temperature of the loop heat pipe is lower than a freezing point of the working fluid, the working fluid freezes and solidifies in the loop heat pipe. On this occasion, volume expansion may occur as the working fluid undergoes a liquid-to-solid phase change. When such volume expansion occurs, the loop heat pipe may be deformed.

SUMMARY

Certain embodiment provide a loop heat pipe.

The loop heat pipe comprises:

an evaporator configured to vaporize a working fluid;

a condenser configured to condense the working fluid;

a liquid pipe that connects the evaporator and the condenser to each other; and a vapor pipe that connects the evaporator and the condenser to each other so as to form a loop together with the liquid pipe.

Each of the evaporator, the condenser, the liquid pipe and the vapor pipe comprises:

a pair of outer metal layers;

an intermediate metal layer provided between the pair of outer metal layers; and a flow channel that is defined by the pair of outer metal layers and the intermediate metal layer and through which the working fluid flows, and At least one of the evaporator, the condenser, the liquid pipe and the vapor pipe further comprises a reinforcing member that is built in at least one of the pair of outer metal layers and that is higher in rigidity than the pair of outer metal layers.

DESCRIPTION OF EMBODIMENT

An embodiment will be described below with reference to the accompanying drawings.

Incidentally, for convenience, the accompanying drawings may show each characteristic portion in an enlarged manner in order to make the characteristic easy to understand, and a dimensional ratio among constituent elements may be different among the drawings. Further, in order to make sectional structures of members easy to understand in sectional view, some of the members to be hatched will be not hatched but drawn in a satin pattern. Incidentally, in the present specification, the expression "plan view" means a view of an object from a vertical direction (illustrated up/down direction) of FIG. 2 and the like, and the expression "planar shape" means a shape of the object from the vertical direction of FIG. 2 and the like. Further, the expressions "up/down direction" and "left/right direction" in the present specification are directions when, of each drawing, a side in which reference signs indicating the members can be accurately read is set at a normal position.

Figure 1:
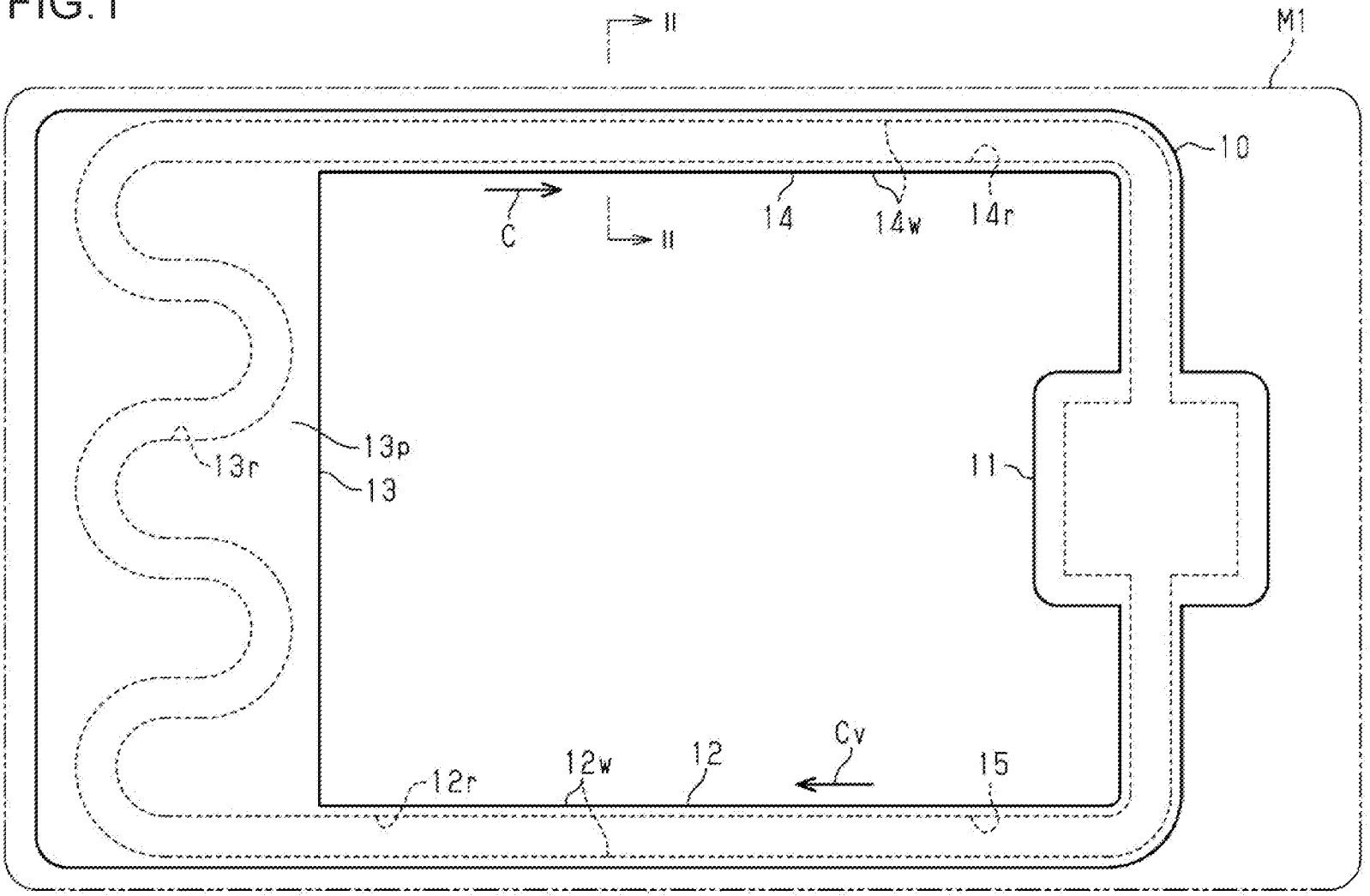
FIG. 1 is a schematic plan view showing a loop heat pipe according to an embodiment.

A loop heat pipe 10 shown in FIG. 1 is, for example, accommodated in a mobile type electronic apparatus M1 such as a smartphone or a tablet terminal. The loop heat pipe 10 has an evaporator 11, a vapor pipe 12, a condenser 13, and a liquid pipe 14.

The evaporator 11 and the condenser 13 are connected to each other by the vapor pipe 12 and the liquid pipe 14. The evaporator 11 has a function of vaporizing a working fluid C to generate vapor Cv. The vapor Cv generated in the evaporator 11 is sent to the condenser 13 through the vapor pipe 12. The condenser 13 has a function of condensing the vapor Cv of the working fluid C. The liquefied working fluid C is sent to the evaporator 11 through the liquid pipe 14. The vapor pipe 12 and the liquid pipe 14 form a loop-like flow channel 15 through which the working fluid C or the vapor Cv is made to flow.

The vapor pipe 12 is, for example, formed into a long tubular body. The liquid pipe 14 is, for example, formed into a long tubular body. In the present embodiment, the vapor pipe 12 and the liquid pipe 14 have, for example, the same dimensions (that is, lengths) in a length direction. Incidentally, the length of the vapor pipe 12 and the length of the liquid pipe 14 may be different from each other. For example, the length of the vapor pipe 12 may be shorter than the length of the liquid pipe 14. Here, the "length direction" of the evaporator 11, the vapor pipe 12, the condenser 13, and the liquid pipe 14 in the present specification is a direction consistent with a direction (see arrows in FIG. 1) in which the working fluid C or the vapor Cv in each member flows.

The evaporator 11 is fixed in close contact with a heating component (not shown). The working fluid C in the evaporator 11 is vaporized by heat generated by the heating component, so that the vapor Cv is generated. Incidentally, a thermal interface material (TIM) may be interposed between the evaporator 11 and the heating component. The TIM reduces thermal contact resistance between the heating component and the evaporator 11 to make the heat be conducted from the heating component to the evaporator 11 smoothly.

The vapor pipe 12 has, for example, a pair of pipe walls 12*w* that are provided on opposite sides in a width direction orthogonal to the length direction of the vapor pipe 12 in plan view, and a flow channel 12*r* that is provided between the pair of pipe walls 12*w*. The flow channel 12*r* communicates with an internal space of the evaporator 11. The flow channel 12*r* is a part of the loop-like flow channel 15. The vapor Cv generated in the evaporator 11 is guided to the condenser 13 through the vapor pipe 12.

The condenser 13 has, for example, a heat dissipating plate 13*p* whose area has been increased for heat dissipation, and a flow channel 13*r* that meanders inside the heat dissipating plate 13*p*. The flow channel 13*r* is a part of the loop-like flow channel 15. The vapor Cv guided through the vapor pipe 12 is liquefied in the condenser 13.

The liquid pipe 14 has, for example, a pair of pipe walls 14*w* that are provided on opposite sides in the width direction orthogonal to the length direction of the liquid pipe 14 in plan view, and a flow channel 14*r* that is provided between the pair of pipe walls 14*w*. The flow channel 14*r* communicates with the flow channel 13*r* of the condenser 13, and communicates with the internal space of the evaporator 11. The flow channel 14*r* is a part of the loop-like flow channel 15. The working fluid C liquefied in the condenser 13 is guided to the evaporator 11 through the liquid pipe 14.

Thus, in the loop heat pipe 10, the heat generated by the heating component is transferred to the condenser 13 and dissipated in the condenser 13. As a result, the heating component is cooled so that an increase in temperature of the heating component can be suppressed.

Here, it is preferable that a fluid high in vapor pressure and large in latent heat of vaporization is used as the working fluid C. By use of such a working fluid C, the heating component can be efficiently cooled by the latent heat of vaporization. For example, ammonia, water, chlorofluorocarbon, alcohol, acetone, or the like, can be used as the working fluid C.

Figure 2:
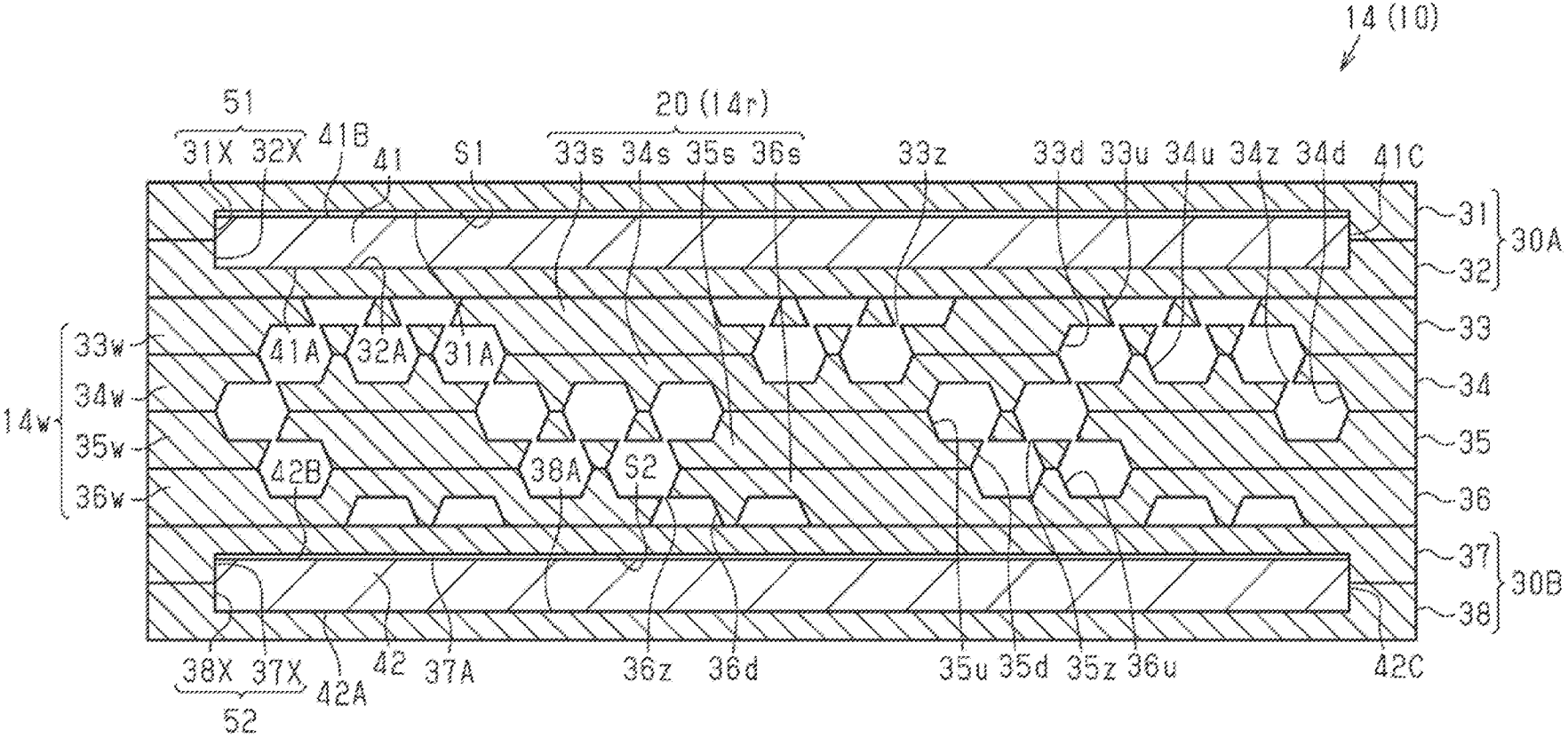
FIG. 2 is a schematic sectional view (sectional view taken along a line II-II in FIG. 1) showing a liquid pipe according to the embodiment.

FIG. 2 shows a section of the liquid pipe 14 taken along a line II-II of FIG. 1. The section is a face orthogonal to the direction (the direction indicated by the arrow in FIG. 1) in which the working fluid C flows in the liquid pipe 14. As shown in FIG. 2, the liquid pipe 14 has a porous body 20. The porous body 20 is, for example, formed so as to extend from the condenser 13 (see FIG. 1) to the evaporator 11 (see FIG. 1) along the length direction of the liquid pipe 14. The porous body 20 guides the working fluid C liquefied in the condenser 13 to the evaporator 11 by capillary force generated in the porous body 20. The porous body 20 has, for example, a large number of pores 33*z*, 34*z*, 35*z*, and 36*z*. The large number of the pores 33*z*, 34*z*, 35*z* and 36*z* function as the flow channel 14*r* through which the working fluid C flows. Incidentally, although not shown, a porous body similar to or the same as the porous body 20 is also provided in the evaporator 11 shown in FIG. 1.

The liquid pipe 14 has, for example, a structure in which eight metal layers 31, 32, 33, 34, 35, 36, 37, and 38 are stacked. Here, the metal layers 31 and 32 form one (an upper side, in this case) outer metal layer 30A, and the metal layers 37 and 38 form the other (a lower side, in this case) outer metal layer 30B. On this occasion, the outer metal layers 30A and 30B function as wall portions (a ceiling portion and a bottom portion) of the liquid pipe 14. In other words, the liquid pipe 14 has a structure in which the paired outer metal layers 30A and 30B, and the metal layers 33 to 36 serving as intermediate metal layers are stacked between the outer metal layer 30A (the metal layers 31 and 32) and the outer metal layer 30B (the metal layers 37 and 38). Further, the liquid pipe 14 includes the paired outer metal layers 30A and 30B, and the flow channel defined by the intermediate metal layers.

Each of the metal layers 31 to 38 is, for example, a copper (Cu) layer having excellent heat conductivity. The metal layers 31 to 38 are, for example, directly bonded to one another by solid-phase bonding such as diffusion bonding, pressure welding, friction welding or ultrasonic bonding. Incidentally, to make it easy to understand in FIG. 2, the metal layers 31 to 38 are distinguished from one another by a solid line. When, for example, the metal layers 31 to 38 are integrated by the diffusion bonding, an interface between adjacent ones of the metal layers 31 to 38 may disappear so that a boundary therebetween may be unclear. Here, the solid-phase bonding is a method in which objects to be bonded are not melted into each other but softened by heat in a solid-phase (solid) state, and then plastically deformed by further heat to be bonded to each other. Incidentally, each of the metal layers 31 to 38 is not limited to the copper layer, but may be formed of a stainless steel layer, an aluminum layer, a magnesium alloy layer, or the like. Further, a material used for forming some of the stacked metal layers 31 to 38 may be different from a material used for forming the others of the metal layers 31 to 38. Each of the metal layers 31 to 38 can be, for example, made about 50 μm to 200 μm thick. Incidentally, some of the metal layers 31 to 38 may be made different in thickness from the others of the metal layers 31 to 38, or all the metal layers 31 to 38 may be made different in thickness from one another.

The liquid pipe 14 has, for example, a reinforcing member 41 built in the outer metal layer 30A, and a reinforcing member 42 built in the outer metal layer 30B. The reinforcing member 41, 42 is higher in rigidity than the outer metal layer 30A, 30B. The reinforcing member 41, 42 is, for example, higher in flexural rigidity than the outer metal layer 30A, 30B. For example, the reinforcing member 41 is higher in flexural rigidity than each of the metal layers 31 and 32.

For example, the reinforcing member 42 is higher in flexural rigidity than each of the metal layers 37 and 38. For example, a material higher in mechanical strength (such as rigidity or hardness) than the material used for forming the outer metal layer 30A, 30B can be used as the material of the reinforcing member 41, 42. For example, any of a metal material and a non-metal material can be used as the material of the reinforcing member 41, 42. For example, when the material of the reinforcing member 41, 42 is a metal material, stainless steel or the like can be used. When the material of the reinforcing member 41, 42 is a non-metal material, for example, carbon fiber reinforced plastic, glass fiber reinforced plastic, or the like, can be used.

As shown in FIG. 2, the liquid pipe 14 according to the present embodiment includes the stacked metal layers 31 to 38 and the reinforcing members 41 and 42. The metal layers 31 to 38 have the pipe walls 14*w* and the porous body 20.

First, structures of the metal layers 33 to 36, which serve as the intermediate metal layers, will be described. The metal layer 33 is a pair of wall portions 33*w* and a porous body 33*s*. The pair of wall portions 33*w* are provided at opposite ends in the width direction (left/right direction in FIG. 2) of the liquid pipe 14 orthogonal to both a direction in which the metal layers 31 to 38 are stacked and the length direction of the liquid pipe 14. The porous body 33*s* is provided between the pair of wall portions 33*w*. The metal layer 34 has a pair of wall portions 34*w* and a porous body 34*s*. The pair of wall portions 34*w* are provided at opposite ends in the width direction of the liquid pipe 14. The porous body 34*s* is provided between the pair of wall portions 34*w*. The metal layer 35 has a pair of wall portions 35*w* and a porous body 35*s*. The pair of wall portions 35*w* are provided at opposite ends in the width direction of the liquid pipe 14. The porous body 35*s* is provided between the pair of wall portions 35*w*. The metal layer 36 has a pair of wall portions 36*w* and a porous body 36*s*. The pair of wall portions 36*w* are provided at opposite ends in the width direction of the liquid pipe 14. The porous body 36*s* is provided between the pair of wall portions 36*w*.

Next, a specific structure of each of the pipe walls 14*w* will be described. The pipe wall 14*w* is constituted by the wall portions 33*w* to 36*w* respectively belonging to the intermediate metal layers 33 to 36 among the metal layers 31 to 38. The pipe wall 14*w* has a configuration in which the wall portions 33*w* to 36*w* are stacked sequentially. No holes or grooves are formed in the wall portions 33*w* to 36*w* according to the present embodiment.

Next, a specific structure of the porous body 20 will be described. The porous body 20 is constituted by the porous bodies 33*s* to 36*s* respectively belonging to the intermediate metal layers 33 to 36 among the metal layers 31 to 38. The porous body 20 has a configuration in which the porous bodies 33*s* to 36*s* are stacked sequentially.

The porous body 33*s* has bottomed holes 33*u* and bottomed holes 33*d*. Each of the bottomed holes 33*u* is recessed to extend from an upper face of the metal layer 33 to a thicknesswise central portion of the metal layer 33. Each of the bottomed holes 33*d* is recessed to extend from a lower face of the metal layer 33 to a thicknesswise central portion of the metal layer 33. An inner wall of each of the bottomed holes 33*u* and 33*d* can be formed into a tapered shape that is widened as it goes from a bottom face side (the thicknesswise central portion side of the metal layer 33) toward an opening side (the upper or lower face side of the metal layer 33). Incidentally, the inner wall of the bottomed hole 33*u*, 33*d* may be, for example, formed so as to extend perpendicularly to the bottom face of the bottomed hole 33*u*, 33*d*. Further, an inner wall face of the bottomed hole 33*u*, 33*d* may be formed into a concave shape which is semicircular or semielliptical in sectional view. Here, in the present specification, the expression "semicircular shape" includes not only a semicircle obtained by bisecting a perfect circle, but also, for example, a shape having an arc longer or shorter than the semicircle. Further, in the present specification, the expression "semielliptical shape" includes not only a semi-ellipse obtained by bisecting an ellipse, but also, for example, a shape having an arc longer or shorter than the semi-ellipse. Further, the bottomed hole 33*u*, 33*d* may be formed into a shape in which the inner wall is continuous in an arc shape toward the bottom face.

Figure 3:
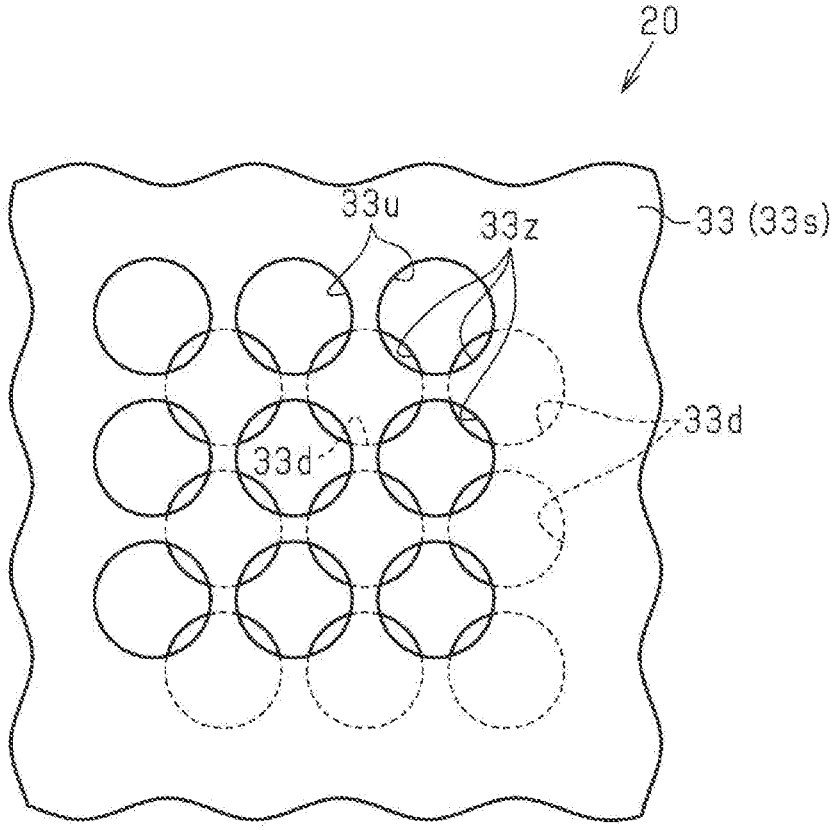
FIG. 3 is a schematic plan view showing a porous body according to the embodiment.

As shown in FIG. 3, each of the bottomed holes 33*u* and 33*d* is, for example, formed into a circular shape in plan view. A diameter of the bottomed hole 33*u*, 33*d* can be, for example, set at about 100 μm to 400 μm. Incidentally, the bottomed hole 33*u*, 33*d* may be formed into any shape such as an ellipse or a polygon in plan view. The bottomed holes 33*u* and the bottomed holes 33*d* partially overlap with each other in plan view. As shown in FIG. 2 and FIG. 3, in the portions in which the bottomed holes 33*u* and the bottomed holes 33*d* overlap with each other in plan view, the bottomed holes 33*u* and the bottomed holes 33*d* partially communicate with each other to form the pores 33*z*. FIG. 3 is an explanatory view showing an array state of the bottomed holes 33*u* and 33*d*, and the pores 33*z* where the bottomed holes 33*u* and 33*d* partially overlap with each other. Such a porous body 33*s* having the bottomed holes 33*u* and 33*d* and the pores 33*z* constitutes a part of the porous body 20.

As shown in FIG. 2, the porous body 34*s* has bottomed holes 34*u* and bottomed holes 34*d*. Each of the bottomed holes 34*u* is recessed to extend from an upper face of the metal layer 34 to a thicknesswise central portion of the metal layer 34. Each of the bottomed holes 34*d* is recessed from a lower face of the metal layer 34 to a thicknesswise central portion of the metal layer 34. The bottomed holes 34*u* and 34*d* can be formed to have a shape similar to or the same as the bottomed holes 33*u* and 33*d* of the metal layer 33. The bottomed holes 34*u* and the bottomed holes 34*d* partially overlap with each other in plan view. In the portions where the bottomed holes 34*u* and the bottomed holes 34*d* overlap with each other in plan view, the bottomed holes 34*u* and the bottomed holes 34*d* partially communicate with each other to form the pores 34*z*. Such a porous body 34*s* having the bottomed holes 34*u* and 34*d* and the pores 34*z* constitutes a part of the porous body 20.

The bottomed holes 33*d* of the metal layer 33 and the bottomed holes 34*u* of the metal layer 34 are, for example, formed at positions where they overlap with each other in plan view. Therefore, no pores are formed at an interface between the bottomed holes 33*d* and the bottomed holes 34*u*.

The porous body 35*s* has bottomed holes 35*u* and bottomed holes 35*d*. Each of the bottomed holes 35*u* is recessed from an upper face of the metal layer 35 to a thicknesswise central portion of the metal layer 35. Each of the bottomed holes 35*d* is recessed from a lower face of the metal layer 35 to a thicknesswise central portion of the metal layer 35. The bottomed holes 35*u* and 35*d* can be formed to have a shape similar to or the same as the bottomed holes 33*u* and 33*d* of the metal layer 33. The bottomed holes 35*u* and the bottomed holes 35*d* partially overlap with each other in plan view. In the portions where the bottomed holes 35*u* and the bottomed holes 35*d* overlap with each other in plan view, the bottomed holes 35*u* and the bottomed holes 35*d* partially communicate with each other to form the pores 35*z*. Such a porous body 35*s* having the bottomed holes 35*u* and 35*d* and the pores 35*z* constitutes a part of the porous body 20.

The bottomed holes 34*d* of the metal layer 34 and the bottomed holes 35*u* of the metal layer 35 are, for example, formed at positions where they overlap with each other in plan view. Therefore, no pores are formed at an interface between the bottomed holes 34*d* and the bottomed holes 35*u*.

The porous body 36*s* has bottomed holes 36*u* and bottomed holes 36*d*. Each of the bottomed holes 36*u* is recessed to extend from an upper face of the metal layer 36 to a thicknesswise central portion of the metal layer 36. Each of the bottomed holes 36*d* is recessed to extend from a lower face of the metal layer 36 to a thicknesswise central portion of the metal layer 36. The bottomed holes 36*u* and 36*d* can be formed to have a shape similar to or the same as the bottomed holes 33*u* and 33*d* of the metal layer 33. The bottomed holes 36*u* and the bottomed holes 36*d* partially overlap with each other in plan view. In the portions where the bottomed holes 36*u* and the bottomed holes 36*d* overlap with each other in plan view, the bottomed holes 36*u* and the bottomed holes 36*d* partially communicate with each other to form the pores 36*z*. Such a porous body 36*s* having the bottomed holes 36*u* and 36*d* and the pores 36*z* constitutes a part of the porous body 20.

The bottomed holes 35*d* of the metal layer 35 and the bottomed holes 36*u* of the metal layer 36 are, for example, formed at positions where they overlap with each other in plan view. Therefore, no pores are formed at an interface between the bottomed holes 35*d* and the bottomed holes 36*u*.

The pores 33*z*, 34*z*, 35*z*, and 36*z* formed in the metal layers 33 to 36 communicate with one another. The pores 33*z*, 34*z*, 35*z*, and 36*z* communicating with one another three-dimensionally expand in the porous body 20. The working fluid C (see FIG. 1) three-dimensionally spreads in the pores 33*z* to 36*z* communicating with one another due to capillary force. Thus, the pores 33*z* to 36*z* function as the flow channel 14*r* through which the working fluid C in the liquid phase flows.

Next, a structure of the outer metal layer 30A will be described. The outer metal layer 30A has, for example, the metal layer 31, and the metal layer 32 that is stacked on the metal layer 31. The outer metal layer 30A according to the present embodiment is constituted by the metal layer 31 that serves as the outermost metal layer, and the metal layer 32 that is stacked on, of the metal layer 31, a lower face located on a side of the metal layer 33 that serves as one of the intermediate metal layers. In other words, the outer metal layer 30A is constituted by the metal layer 32 and the metal layer 31 that are sequentially stacked on the upper face of the metal layer 33.

The outer metal layer 30A has, for example, an accommodating portion 51 accommodating the reinforcing member 41. The accommodating portion 51 is provided inside the outer metal layer 30A. The accommodating portion 51 is, for example, surrounded by the metal layers 31 and 32 that are integrated as the outer metal layer 30A. The accommodating portion 51 is, for example, provided to be separated from the flow channel 14*r*. For example, the accommodating portion 51 is provided to be separated from the flow channel of the porous body 20. The accommodating portion 51 is, for example, provided to be physically separated from the porous body 20 by the metal layer 32. For example, the accommodating portion 51 does not communicate with the bottomed holes 33*u* to 36*u* and 33*d* to 36*d* and the pores 33*z* to 36*z* of the metal layers 33 to 36. Therefore, the working fluid C does not flow into the accommodating portion 51.

The accommodating portion 51 is, for example, formed at a position where it overlaps with the flow channel 14*r* in plan view. The accommodating portion 51 is, for example, formed at the position where it overlaps with the porous body 20 in plan view. In other words, the accommodating portion 51 faces the flow channel 14*r* of the porous body 20 in the thickness direction of the loop heat pipe. The accommodating portion 51 is, for example, formed so as to extend in the width direction of the liquid pipe 14. The accommodating portion 51 is, for example, formed so as to extend over an entire widthwise length of the porous body 20. For example, the accommodating portion 51 is formed at a position where it overlaps with the entire porous body 20 in plan view. The accommodating portion 51 is, for example, formed so as not to overlap with the wall portions 33*w* to 36*w* of the metal layers 33 to 36 in plan view. For example, the accommodating portion 51 is formed to be only inner than the wall portions 33*w* to 36*w* in the width direction of the liquid pipe 14. The accommodating portion 51 is, for example, formed so as to extend in the length direction of the liquid pipe 14. For example, the accommodating portion 51 is formed so as to extend over an entire lengthwise length of the liquid pipe 14.

The accommodating portion 51 is, for example, constituted by a recess 31X formed in, of the metal layer 31, an end face (the lower face in this case) facing the metal layer 32, and a recess 32X formed in, of the metal layer 32, an end face (an upper face in this case) facing the metal layer 31. The recess 31X and the recess 32X communicate with each other. The recess 31X is formed so as to be recessed from the lower face of the metal layer 31 toward an upper face of the metal layer 31. The recess 32X is formed so as to be recessed from the upper face of the metal layer 32 toward a lower face of the metal layer 32.

Here, the verb "face" in the present specification means that faces or members are located in front of each other, and includes not only a case where the faces or members are located completely in front of each other, but also a case where the faces or members are located partially in front of each other. Further, the verb "face" in the present specification includes both a case where another member than the two faces or members is interposed between the two faces or members, and a case where nothing is interposed between the two faces or members.

The recess 31X and the recess 32X are, for example, formed at positions where they overlap with each other in plan view. In other words, the recess 31X and the recess 32X face each other in the thickness direction of the loop heat pipe. For example, a widthwise length of the recess 31X is equal to a widthwise length of the recess 32X. Each of the recesses 31X and 32X is, for example, formed into a rectangular shape in sectional view. An inner wall of the recess 31X, 32X is, for example, formed so as to extend perpendicularly to a bottom face of the recess 31X, 32X. The inner wall of the recess 31X, 32X may be, for example, formed into a tapered shape that is widened from the bottom face side toward an opening side. Further, the recess 31X, 32X may be formed into a shape in which the inner wall is continuous in an arc shape toward the bottom face.

Here, the expression "equal" in the present specification includes not only a case where comparison targets are exactly equal to each other but also a case where there is a slight difference between the comparison targets due to an influence of dimensional tolerances etc. The reinforcing member 41 is accommodated in the accommodating portion 51. The reinforcing member 41 is formed to have a size small enough to be accommodated in the accommodating portion 51. The reinforcing member 41 is, for example, formed into a shape extending along an inner face of the accommodating portion 51. In other words, the inner face of the accommodating portion 51 is, for example, formed into a shape extending along an outer face of the reinforcing member 41. The reinforcing member 41 is, for example, formed into a flat plate shape. The reinforcing member 41 is, for example, formed into a rectangular shape in sectional view. The reinforcing member 41 extends, for example, along the width direction of the liquid pipe 14. The reinforcing member 41 extends, for example, over an entire length of the accommodating portion 51 in the width direction of the liquid pipe 14. The reinforcing member 41 extends, for example, along the length direction of the liquid pipe 14. The reinforcing member 41 extends, for example, over the entire lengthwise length of the liquid pipe 14.

The reinforcing member 41 has, for example, an end face 41A, an end face 41B, and a pair of side faces 41C. The end face 41B is provided on an opposite side to the end face 41A. The pair of side faces 41C are provided between the end face 41A and the end face 41B. The end faces 41A and 41B are, for example, orthogonal to the vertical direction. The end face 41A is, for example, located on a vertically lower side of the reinforcing member 41. The side faces 41C are, for example, orthogonal to the width direction of the liquid pipe 14. Each of the side faces 41C extends, for example, along the vertical direction.

The reinforcing member 41 is, for example, provided inside the accommodating portion 51 so that the end face 41A is in contact with the inner face of the accommodating portion 51 and the end face 41B is separated from the inner face of the accommodating portion 51. The end face 41A is, for example, in contact with a bottom face 32A of the recess 32X. Here, the contact between the end face 41A and the bottom face 32A may be attained in any form of face contact, line contact, and point contact. The end face 41A and the bottom face 32A may be bonded to each other or may be not bonded to each other. A gap S1 is formed between the end face 41B and a bottom face 31A of the recess 31X. The gap S1 is, for example, formed so as to extend in the width direction of the liquid pipe 14. The gap S1 is, for example, formed so as to extend over an entire length of the reinforcing member 41 in the width direction of the liquid pipe 14. The gap S1 is, for example, formed so as to extend in the length direction of the liquid pipe 14. The gap S1 is, for example, formed so as to extend over an entire length of the reinforcing member 41 in the length direction of the liquid pipe 14. The reinforcing member 41 is, for example, formed to be smaller than the accommodating portion 51 so that the gap S1 is formed when the reinforcing member 41 is accommodated in the accommodating portion 51.

The reinforcing member 41 is, for example, provided inside the accommodating portion 51 so that the side faces 41C are in contact with the inner face of the accommodating portion 51. The reinforcing member 41 is, for example, provided inside the accommodating portion 51 so that both the side faces 41C are in contact with inner wall faces of the recesses 31X and 32X. Thus, movement of the reinforcing member 41 inside the accommodating portion 51 is restricted. Here, the contact between the side faces 41C and the inner wall faces of the recesses 31X and 32X may be attained in any form of face contact, line contact, and point contact.

Next, a structure of the outer metal layer 30B will be described. The outer metal layer 30B has, for example, the metal layer 38, and the metal layer 37 that is stacked on the metal layer 38. The outer metal layer 30B according to the present embodiment is constituted by the metal layer 38 that serves as an outermost metal layer, and the metal layer 37 that is stacked on, of the metal layer 38, an upper face located on a side of the metal layer 36 that serves as an intermediate metal layer. In other words, the outer metal layer 30B is constituted by the metal layer 37 and the metal layer 38 that are sequentially stacked on the lower face of the metal layer 36.

The outer metal layer 30B has, for example, an accommodating portion 52 accommodating the reinforcing member 42. The accommodating portion 52 is provided inside the outer metal layer 30B. The accommodating portion 52 is, for example, surrounded by the metal layers 37 and 38 that are integrated as the outer metal layer 30B. The accommodating portion 52 is, for example, provided to be separated from the flow channel 14*r*. For example, the accommodating portion 52 is provided to be separated from the flow channel of the porous body 20. The accommodating portion 52 is provided to be separated from the porous body 20. The accommodating portion 52 is, for example, provided to be physically separated from the porous body 20 by the metal layer 37. For example, the accommodating portion 52 does not communicate with the bottomed holes 33*u* to 36*u* and 33*d* to 36*d* and the pores 33*z* to 36*z* of the metal layers 33 to 36. Therefore, the working fluid C does not flow into the accommodating portion 52.

The accommodating portion 52 is, for example, formed at a position where it overlaps with the flow channel 14*r* in plan view. The accommodating portion 52 is, for example, formed at a position where it overlaps with the porous body 20 in plan view. The accommodating portion 52 is, for example, formed at a position where it overlaps with the accommodating portion 51 in plan view. In other words, the accommodating portion 52 and the accommodating portion 51 face each other in the thickness direction of the loop heat pipe. The accommodating portion 52 is, for example, formed so as to extend in the width direction of the liquid pipe 14. The accommodating portion 52 is, for example, formed so as to extend over the entire widthwise length of the porous body 20. For example, the accommodating portion 52 is formed at a position where it overlaps with the entire porous body 20 in plan view. The accommodating portion 52 is, for example, formed so as not to overlap with the wall portions 33*w* to 36*w* of the metal layers 33 to 36 in plan view. For example, the accommodating portion 52 is formed to be only inner than the wall portions 33*w* to 36*w* in the width direction of the liquid pipe 14. The accommodating portion 52 is, for example, formed so as to extend in the length direction of the liquid pipe 14. For example, the accommodating portion 52 is formed so as to extend over the entire lengthwise length of the liquid pipe 14.

The accommodating portion 52 is, for example, constituted by a recess 37X and a recess 38X. The recess 37X is formed in, of the metal layer 37, an end face (a lower face in this case) facing the metal layer 38. The recess 38X is formed in, of the metal layer 38, an end face (the upper face in this case) facing the metal layer 37. The recess 37X and the recess 38X communicate with each other. The recess 37X is formed so as to be recessed from the lower face of the metal layer 37 toward an upper face of the metal layer 37. The recess 38X is formed so as to be recessed from the upper face of the metal layer 38 toward a lower face of the metal layer 38.

The recess 37X and the recess 38X are, for example, formed at positions where they overlap with each other in plan view. For example, a widthwise length of the recess 37X is equal to a widthwise length of the recess 38X. Each of the recesses 37X and 38X is, for example, formed into a rectangular shape in sectional view. An inner wall of the recess 37X, 38X is, for example, formed so as to extend perpendicularly to a bottom face of the recess 37X, 38X. Incidentally, the inner wall of the recess 37X, 38X may be, for example, formed into a tapered shape that is widened from the bottom face side toward an opening side. Further, the recess 37X, 38X may be formed into a shape in which the inner wall is continuous in an arc shape toward the bottom face.

The reinforcing member 42 is accommodated in the accommodating portion 52. The reinforcing member 42 is formed to have a size small enough to be accommodated in the accommodating portion 52. The reinforcing member 42 is, for example, formed into a shape extending along an inner face of the accommodating portion 52. In other words, the inner face of the accommodating portion 52 is, for example, formed into a shape extending along an outer face of the reinforcing member 42. The reinforcing member 42 is, for example, formed into a flat plate shape. The reinforcing member 42 is, for example, formed into a rectangular shape in sectional view. The reinforcing member 42 extends, for example, along the width direction of the liquid pipe 14. The reinforcing member 42 extends, for example, over an entire length of the accommodating portion 52 in the width direction of the liquid pipe 14. The reinforcing member 42 extends, for example, along the length direction of the liquid pipe 14. The reinforcing member 42 extends, for example, over the entire lengthwise length of the liquid pipe 14. The reinforcing member 42 is formed, for example, to have the same shape and the same size as those of the reinforcing member 41. Incidentally, the reinforcing member 41 and the reinforcing member 42 may be formed into different shapes from each other. Further, the reinforcing member 41 and the reinforcing member 42 may be formed to have different sizes from each other.

The reinforcing member 42 has, for example, an end face 42A, an end face 42B, and a pair of side faces 42C. The end face 42B is provided on an opposite side to the end face 42A. The pair of side faces 42C are provided between the end face 42A and the end face 42B. The end faces 42A and 42B are, for example, orthogonal to the vertical direction. The end face 42A is, for example, located on a vertically lower side of the reinforcing member 42. The side faces 42C are, for example, orthogonal to the width direction of the liquid pipe 14. Each of the side faces 42C extends, for example, along the vertical direction.

The reinforcing member 42 is, for example, provided inside the accommodating portion 52 so that the end face 42A is in contact with the inner face of the accommodating portion 52 and the end face 42B is separated from the inner face of the accommodating portion 52. The end face 42A is, for example, in contact with a bottom face 38A of the recess 38X. Here, the contact between the end face 42A and the bottom face 38A may be attained in any form of face contact, line contact, and point contact. The end face 42A and the bottom face 38A may or may not be bonded to each other. A gap S2 is formed between the end face 42B and a bottom face 37A of the recess 37X. The gap S2 is, for example, formed so as to extend in the width direction of the liquid pipe 14. The gap S2 is, for example, formed so as to extend over an entire length of the reinforcing member 42 in the width direction of the liquid pipe 14. The gap S2 is, for example, formed so as to extend in the length direction of the liquid pipe 14. The gap S2 is, for example, formed so as to extend over an entire length of the reinforcing member 42 in the length direction of the liquid pipe 14. The reinforcing member 42 is, for example, formed to be smaller than the accommodating portion 52 so that the gap S2 is formed when the reinforcing member 42 is accommodated in the accommodating portion 52.

The reinforcing member 42 is, for example, provided inside the accommodating portion 52 so that the side faces 42C are in contact with the inner face of the accommodating portion 52. The reinforcing member 42 is, for example, provided inside the accommodating portion 52 so that both the side faces 42C are in contact with inner wall faces of the recesses 37X and 38X. Thus, movement of the reinforcing member 42 inside the accommodating portion 52 is restricted. Here, the contact between the side faces 42C and the inner wall faces of the recesses 37X and 38X may be attained in any form of surface contact, line contact, and point contact.

Although not shown, an injection port for injecting the working fluid C (see FIG. 1) is provided in the liquid pipe 14. However, the injection port is closed by a sealing member so that the inside of the loop heat pipe 10 is kept airtight.

The evaporator 11, the vapor pipe 12, and the condenser 13 shown in FIG. 1 are formed by stacking the eight metal layers 31 to 38 on one another in a manner similar to or the same as the liquid pipe 14 shown in FIG. 2. That is, the loop heat pipe 10 shown in FIG. 1 is formed by stacking the eight metal layers 31 to 38 on one another. Namely, each of the liquid pipe 14, the evaporator 11, the vapor pipe 12 and the condenser 13 is provided with the pair of outer metal layers, the intermediate metal layers provided between the pair of outer metal layers, and the flow channel defined by the pair of outer metal layers and the intermediate metal layers. For example, the porous body provided in the evaporator 11 is formed into a comb-teeth shape in the evaporator 11. Inside the evaporator 11, a space is formed in a region where the porous body is not provided. For example, through holes thicknesswise penetrating the metal layers 33 to 36 that serve as the intermediate metal layers communicate with one another so that a space (i.e. the flow channel 12*r*) is formed in the metal layers 33 to 36 in the vapor pipe 12. For example, through holes thicknesswise penetrating the metal layers 33 to 36 that serve as the intermediate metal layers communicate with one another so that a space (i.e. the flow channel 13*r*) is formed in the metal layers 33 to 36 in the condenser 13. Incidentally, the number of the stacked metal layers is not limited to eight, but can be set to seven or less, or to nine or more. Further, in the evaporator 11, the vapor pipe 12, and the condenser 13 shown in FIG. 1, the reinforcing member 41 is built in the metal layers 31 and 32 integrated as the outer metal layer 30A, and the reinforcing member 42 is built in the metal layers 37 and 38 integrated as the outer metal layer 30B, in a manner similar to or the same as those in the liquid pipe 14 shown in FIG. 2.

Next, functions of the loop heat pipe 10 will be described. As shown in FIG. 1, the loop heat pipe 10 has the evaporator 11 that vaporizes the working fluid C, the condenser 13 that liquefies the vapor Cv, the vapor pipe 12 that guides the vaporized working fluid (i.e. the vapor Cv) to flow into the condenser 13, and the liquid pipe 14 that guides the liquefied working fluid C to flow into the evaporator 11.

The porous body 20 is provided in the flow channel of the liquid pipe 14. The porous body 20 extends from the condenser 13 to the evaporator 11 along the length direction of the liquid pipe 14. The porous body 20 guides the liquid-phase working fluid C liquefied by the condenser 13, to the evaporator 11 by the capillary force generated in the porous body 20.

Here, in the liquid pipe 14, the reinforcing member 41 is built in the outer metal layer 30A, and the reinforcing member 42 is built in the outer metal layer 30B. Due to the reinforcing members 41 and 42 provided thus, mechanical strength of the outer metal layers 30A and 30B serving as the wall portions of the liquid pipe 14 can be improved. Therefore, in a case where, for example, the working fluid C flowing in the liquid pipe 14 has undergone a liquid-to-solid phase change, deformation of the outer metal layers 30A and 30B can be suppressed even if volume expansion occurs due to the phase change. For example, the electronic apparatus M1 having the loop heat pipe 10 is used in an environment where an ambient temperature is lower than a freezing point of the working fluid C in a cold region, winter, or the like. Even in a case where the working fluid C in the liquid phase freezes to thereby cause freezing expansion, the outer metal layers 30A and 30B, which serve as the wall portions of the liquid pipe 14, can be restrained from being deformed.

Next, a method for manufacturing the loop heat pipe 10 will be described. First, in a step shown in FIG. 4A, a flat plate-like metal sheet 61 is prepared. The metal sheet 61 is a member that will finally serve as a metal layer 31 (see FIG. 2). The metal sheet 61 is, for example, made of copper, stainless steel, aluminum, a magnesium alloy, etc. The metal sheet 61 can be, for example, made about 50 μm to 200 μm thick.

Figures 4A, 4B, 4C, 4D, 4E:
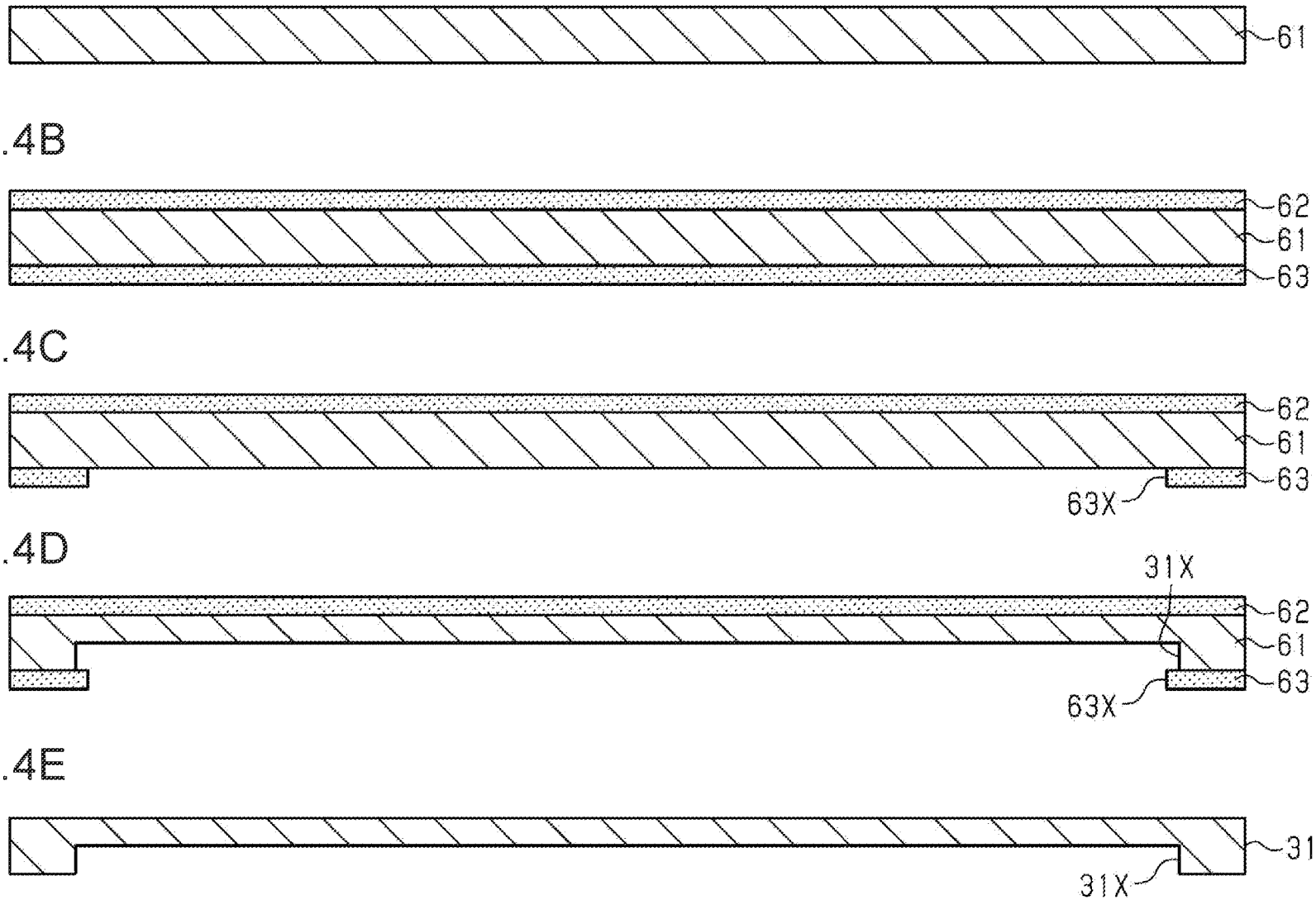
FIGS. 4A to 4E are schematic sectional views showing a method for manufacturing the loop heat pipe according to the embodiment.

Next, in a step shown in FIG. 4B, a resist layer 62 is formed on an upper face of the metal sheet 61, and a resist layer 63 is formed on a lower face of the metal sheet 61. As each of the resist layers 62 and 63, for example, a photosensitive dry film resist or the like can be used.

Subsequently, in a step shown in FIG. 4C, the resist layer 63 is exposed to light and developed so that an opening 63X that selectively exposes the lower face of the metal sheet 61 is formed. The opening 63X is formed so as to correspond to a recess 31X shown in FIG. 2.

Next, in a step shown in FIG. 4D, the metal sheet 61 exposed in the opening 63X is etched from the lower face side of the metal sheet 61. Thus, the recess 31X is formed in the lower face of the metal sheet 61. For example, a ferric chloride solution can be used for etching the metal sheet 61.

Figure 5A:
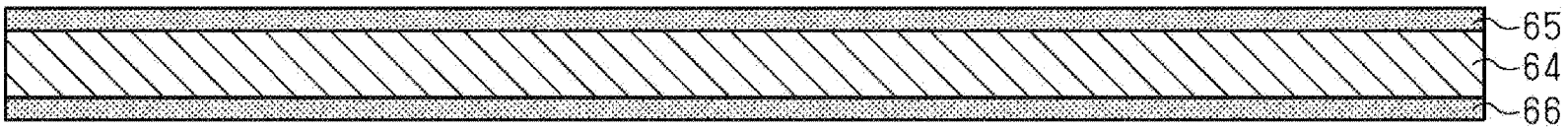
FIGS. 5A to 5D are schematic sectional views showing the method for manufacturing the loop heat pipe according to the embodiment.

Next, the resist layers 62 and 63 are stripped off by a stripping solution. As a result, the metal layer 31 having the recess 31X in its lower face can be formed, as shown in FIG. 4E. Next, in a step shown in FIG. 5A, a flat plate-like metal sheet 64 is prepared. The metal sheet 64 is a member that will finally serve as a metal layer 33 (see FIG. 2). The metal sheet 64 is, for example, made of copper, stainless steel, aluminum, a magnesium alloy, etc. The metal sheet 64 can be, for example, made about 50 μm to 200 μm thick.

Subsequently, a resist layer 65 is formed on an upper face of the metal sheet 64, and a resist layer 66 is formed on a lower face of the metal sheet 64. As each of the resist layers 65 and 66, for example, a photosensitive dry film resist or the like can be used.

Figure 5B:
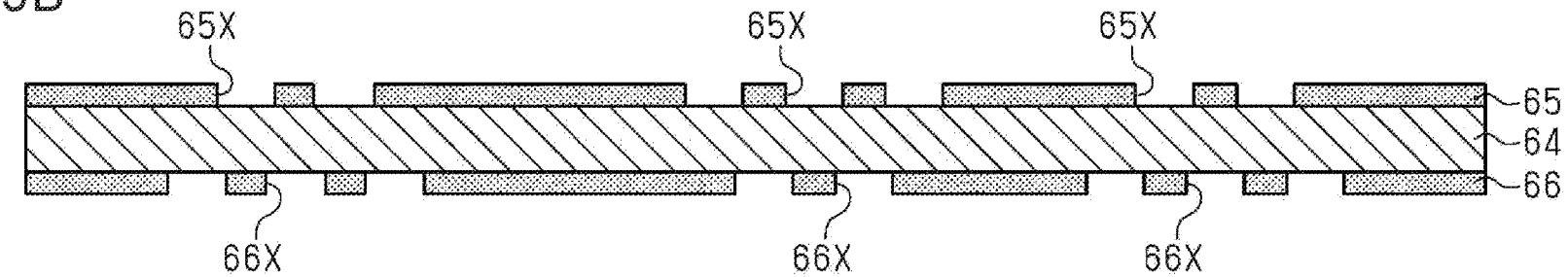

Next, in a step shown in FIG. 5B, the resist layer 65 is exposed to light and developed so that openings 65X that selectively expose the upper face of the metal sheet 64 are formed. In a similar manner or the same manner, the resist layer 66 is exposed to light and developed so that openings 66X that selectively expose the lower face of the metal sheet 64 are formed. The openings 65X are formed so as to correspond to bottomed holes 33*u* shown in FIG. 2. The openings 66X are formed so as to correspond to bottomed holes 33*d* shown in FIG. 2.

Figure 5C:
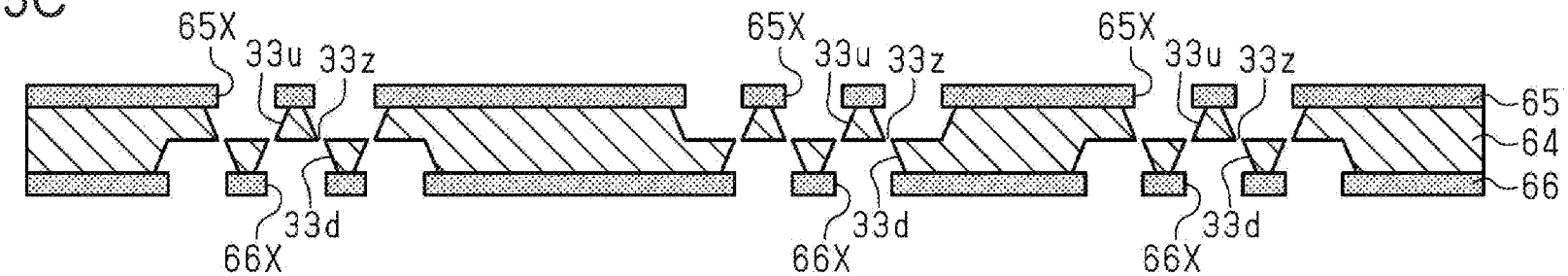

Next, in a step shown in FIG. 5C, the metal sheet 64 exposed in the openings 65X is etched from the upper face side of the metal sheet 64, and the metal sheet 64 exposed in the openings 66X is etched from the lower face side of the metal sheet 64. The bottomed holes 33*u* are formed in the upper face of the metal sheet 64 through the openings 65X, and the bottomed holes 33*d* are formed in the lower face of the metal sheet 64 through the openings 66X. The bottomed holes 33*u* and the bottomed holes 33*d* are formed so as to partially overlap with each other in plan view. The bottomed holes 33*u* and the bottomed holes 33*d* communicate with each other at the overlapping portions so that pores 33*z* are formed. For example, a ferric chloride solution can be used for etching the metal sheet 64.

Figure 5D:
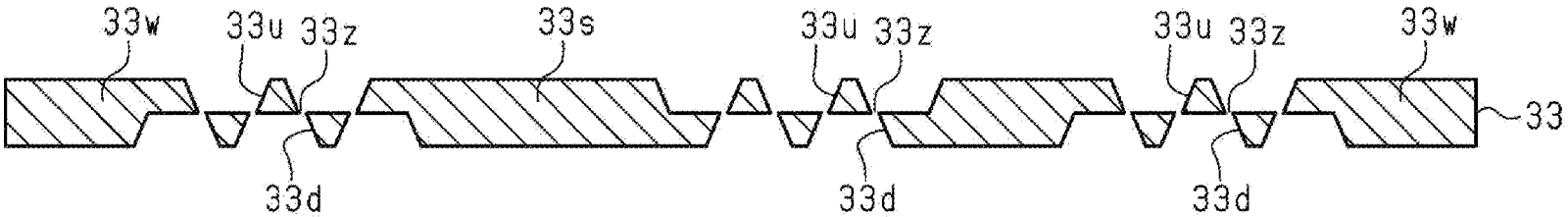

Next, the resist layers 65 and 66 are stripped off by a stripping solution. As a result, the metal layer 33 having a pair of wall portions 33*w* and a porous body 33*s* can be formed, as shown in FIG. 5D.

Figure 6:
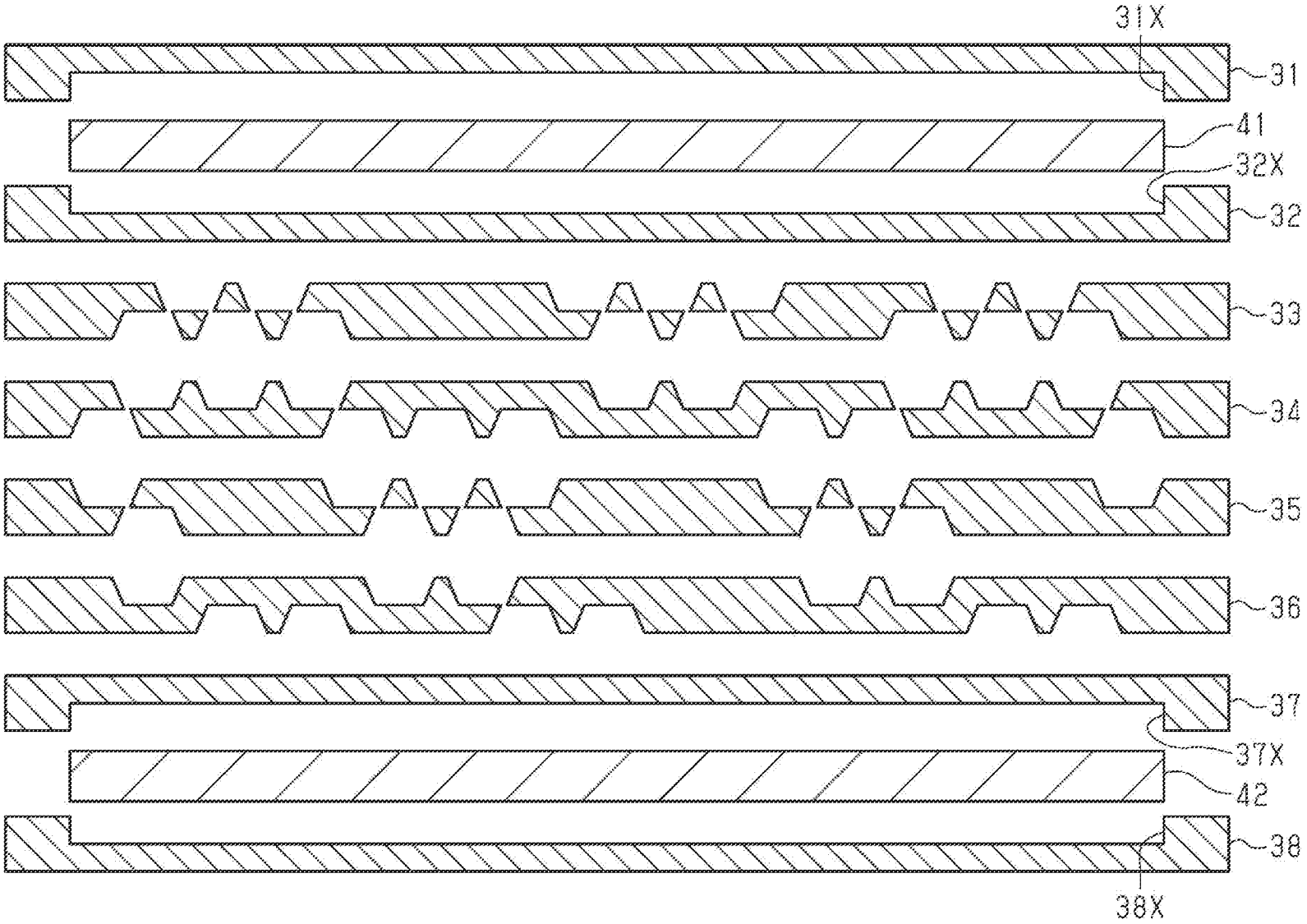
FIG. 6 is a schematic sectional view showing the method for manufacturing the loop heat pipe according to the embodiment.

Subsequently, in a step shown in FIG. 6, metal layers 32, 37, and 38 are formed by a method similar to or the same as the steps shown in FIG. 4A to FIG. 4E, and metal layers 34, 35, and 36 are formed by a method similar to or the same as the steps shown in FIG. 5A to FIG. 5D. In addition, flat plate-like reinforcing members 41 and 42 are prepared. Then, the metal layers 31 and 32 are disposed so as to sandwich the reinforcing member 41 therebetween, the metal layers 37 and 38 are disposed so as to sandwich the reinforcing member 42 therebetween, and the metal layers 33, 34, 35 and 36 are disposed between the metal layer 32 and the metal layer 37. On this occasion, the reinforcing member 41 is disposed at a position where it overlaps with the recesses 31X and 32X of the metal layers 31 and 32 in plan view, and the reinforcing member 42 is disposed at a position where it overlaps with the recesses 37X and 38X of the metal layers 37 and 38 in plan view.

Figure 7:
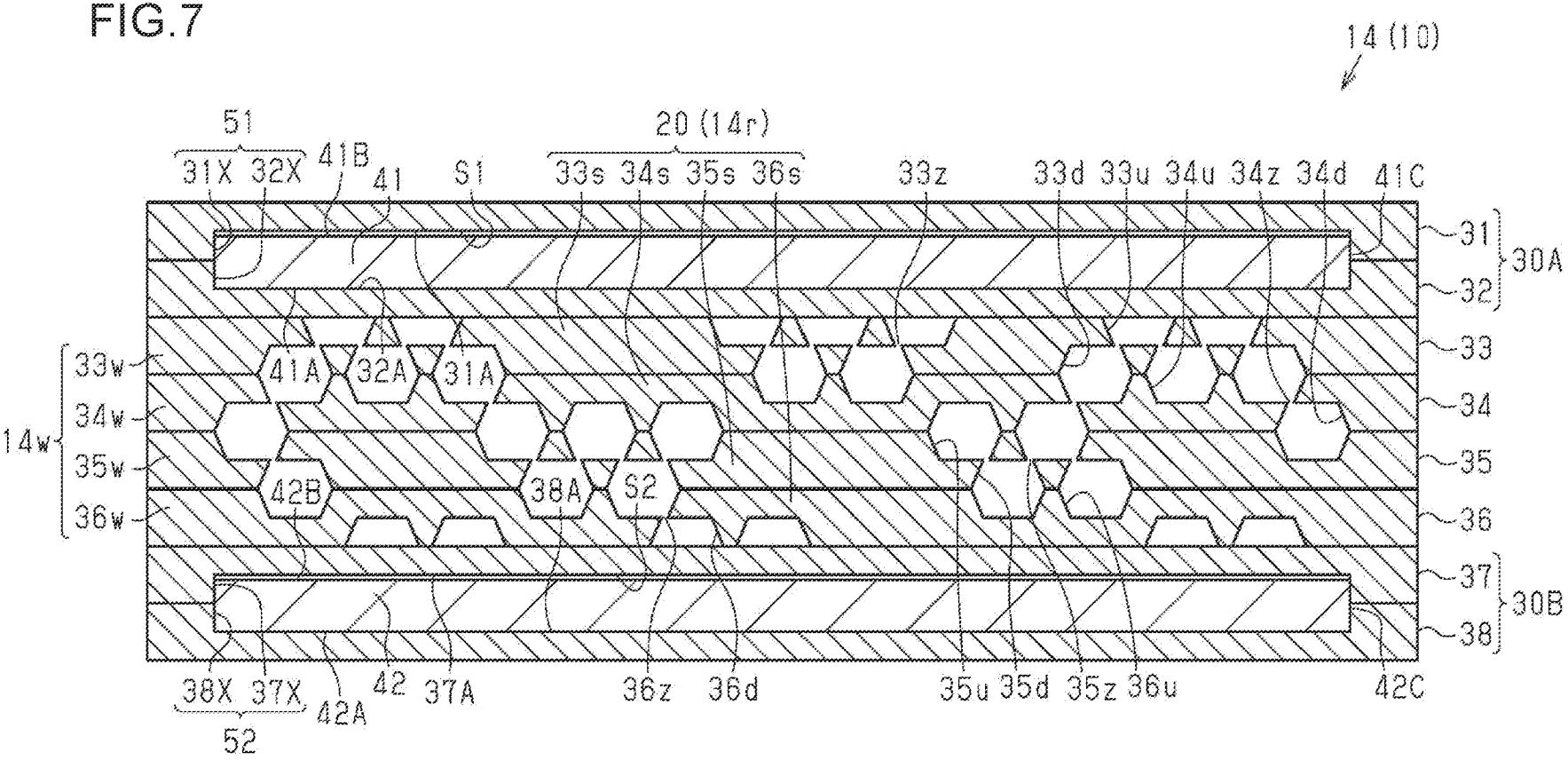
FIG. 7 is a schematic sectional view showing the method for manufacturing the loop heat pipe according to the embodiment.

Next, in a step shown in FIG. 7, the stacked metal layers 31 to 38 and the reinforcing members 41 and 42 are pressed while being heated at a predetermined temperature (e.g. about 900° C.), so that the metal layers 31 to 38 are bonded to one another by solid-phase bonding. As a result, the metal layers 31, 32, 33, 34, 35, 36, 37 and 38 adjacent to one another in the stacking direction are directly bonded to one another. On this occasion, a lower face of the metal layer 31 and an upper face of the metal layer 32 are directly bonded to each other so that an accommodating portion 51 having a configuration where the recess 31X of the metal layer 31 and the recess 32X of the metal layer 32 communicate with each other is formed. Then, the reinforcing member 41 is accommodated in the accommodating portion 51. Here, since the reinforcing member 41 is formed to be smaller than the accommodating portion 51, it is possible to prevent the reinforcing member 41 from hindering close contact between the lower face of the metal layer 31 and the upper face of the metal layer 32. As a result, pressure can be suitably applied to the lower face of the metal layer 31 and the upper face of the metal layer 32 during the pressing so that the lower face of the metal layer 31 and the upper face of the metal layer 32 can be suitably bonded to each other. However, due to a gap S1 formed between an end face 41B of the reinforcing member 41 and a bottom face 31A of the recess 31X, pressure cannot be sufficiently applied to the reinforcing member 41 during the pressing. Therefore, an end face 41A of the reinforcing member 41 and a bottom face 32A of the recess 32X may not be bonded to each other.

In a similar manner or the same manner, a lower face of the metal layer 37 and an upper face of the metal layer 38 are directly bonded to each other so that an accommodating portion 52 having a configuration where the recess 37X of the metal layer 37 and the recess 38X of the metal layer 38 communicate with each other is formed. Then, the reinforcing member 42 is accommodated in the accommodating portion 52. Here, since the reinforcing member 42 is formed to be smaller than the accommodating portion 52, it is possible to prevent the reinforcing member 42 from inhibiting close contact between the lower face of the metal layer 37 and the upper face of the metal layer 38. As a result, pressure can be suitably applied to the lower face of the metal layer 37 and the upper face of the metal layer 38 during the pressing so that the lower face of the metal layer 37 and the upper face of the metal layer 38 can be suitably bonded to each other. However, due to a gap S2 formed between an end face 42B of the reinforcing member 42 and a bottom face 37A of the recess 37X, pressure cannot be sufficiently applied to the reinforcing member 42 during the pressing. Therefore, an end face 42A of the reinforcing member 42 and a bottom face 38A of the recess 38X may not be bonded to each other.

By the aforementioned steps, a structure body having outer metal layers 30A and 30B in which the reinforcing members 41 and 42 are built, and the metal layers 33 to 36 that are stacked between the outer metal layers 30A and 30B is formed. A loop heat pipe 10 having an evaporator 11, a condenser 13, a vapor pipe 12, and a liquid pipe 14 shown in FIG. 1 is formed. On this occasion, a porous body 20 is formed in a flow channel of the liquid pipe 14.

Then, for example, after air inside the liquid pipe 14 is exhausted by use of a vacuum pump or the like, a working fluid C is injected into the liquid pipe 14 from an injection port (not shown), and then the injection port is sealed. Next, functions and effects of the present embodiment will be described.

(1) The reinforcing member 41 is built in the outer metal layer 30A, and the reinforcing member 42 is built in the outer metal layer 30B. Due to the reinforcing members 41 and 42 built thus, mechanical strength of the outer metal layers 30A and 30B serving as the wall portions of the flow channel 14*r* can be improved. Thus, durability against volume expansion of the working fluid C enclosed in the flow channel 14*r* can be improved. Therefore, for example, even in the case where the volume expansion occurs due to the liquid-to-solid phase change of the working fluid C flowing in the flow channel 14*r*, the outer metal layers 30A and 30B can be suppressed from being deformed. As a result, deformation of the loop heat pipe 10 can be suppressed.

(2) By the way, the mechanical strength of the outer metal layers can be improved by plating layers of nickel (Ni) or the like formed on outer faces of outermost ones of the metal layers. However, when a thick plating layer is formed on each of the outer faces of the outermost metal layers, there is a problem that floating or peeling occurs due to stress of the plating layer itself. On the other hand, the reinforcing members 41 and 42 are built in the outer metal layers 30A and 30B in the loop heat pipe 10 according to the present embodiment. Thus, since it is unnecessary to form the plating layers on the outer faces of the outer metal layers 30A and 30B, it is possible to prevent the problem that would occur when the plating layers are formed. Further, the step of forming the plating layers can be omitted.

(3) The reinforcing members 41 and 42 are respectively accommodated in the accommodating portions 51 and 52 that are separated from the loop-like flow channel 15 (e.g. the flow channel 14*r*). According to the configuration, the working fluid C does not flow in the accommodating portions 51 and 52, so that it is possible to suppress the working fluid C from contacting the reinforcing members 41 and 42. Therefore, a material that chemically reacts with the working fluid C can be also selected as the material of the reinforcing members 41 and 42. Therefore, the degree of freedom for selecting the material of the reinforcing members 41 and 42 can be improved.

(4) The reinforcing member 41 is disposed in the accommodating portion 51 such that the gap S1 is formed between the end face 41B and the inner face of the accommodating portion 51. According to the configuration, the reinforcing member 41 is formed to be smaller than the accommodating portion 51. Therefore, it is possible to prevent the reinforcing member 41 from inhibiting the close contact between the lower face of the metal layer 31 and the upper face of the metal layer 32 during the solid-phase bonding. As a result, pressure can be suitably applied to the lower face of the metal layer 31 and the upper face of the metal layer 32 during the pressing, so that the lower face of the metal layer 31 and the upper face of the metal layer 32 can be suitably bonded to each other.

OTHER EMBODIMENTS

The aforementioned embodiment can be modified and implemented as follows. The aforementioned embodiment and the following modifications can be combined with each other and implemented without technically contradicting each other.

Figure 8:
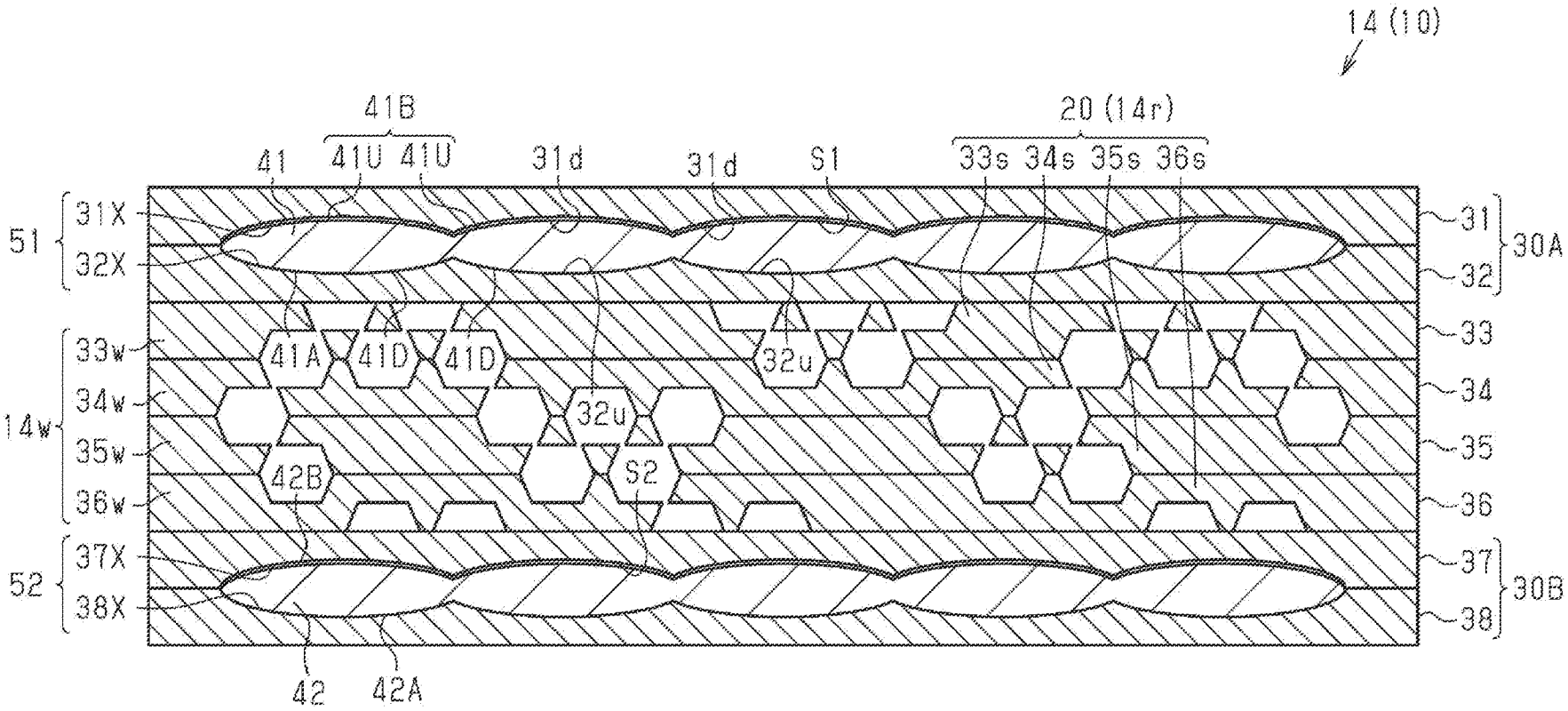
FIG. 8 is a schematic sectional view showing a loop heat pipe according to a modification.

The shapes and sizes of the accommodating portions 51 and 52 and the reinforcing members 41 and 42 according to the aforementioned embodiment are not limited particularly. For example, as shown in FIG. 8, each of inner faces of accommodating portions 51 and 52 may be formed into a shape having a curved face. A recess 31X according to the present modification is, for example, formed by a plurality of (five in this case) bottomed holes 31*d*, that are connected to one another in a row and each of which is recessed from a lower face of a metal layer 31 toward an upper face of the metal layer 31. The plurality of bottomed holes 31*d* are, for example, formed continuously to one another along a width direction of a liquid pipe 14. An inner face of each of the bottomed holes 31*d* is, for example, formed into a concave shape that is semielliptical or semicircular in sectional view. An inner face of the recess 31X according to the present modification is formed into a sectional shape in which semielliptical arcs of the bottomed holes 31*d* are continuous to one another along the width direction of the liquid pipe 14. In a similar manner or the same manner, a recess 32X according to the present modification is formed, for example, by a plurality of (five in this case) bottomed holes 32*u* that are connected to one another in a row and each of which is recessed from an upper face of a metal layer 32 toward a lower face of the metal layer 32. The plurality of bottomed holes 32*u* are, for example, formed continuously to one another along the width direction of the liquid pipe 14. An inner face of each of the bottomed holes 32*u* is, for example, formed into a concave shape that is semielliptical or semicircular in sectional view. An inner face of the recess 32X according to the present modification is formed into a sectional shape in which semielliptical arcs of the plurality of bottomed holes 32*u* are continuous to one another along the width direction of the liquid pipe 14. The accommodating portion 51 has a configuration in which the recess 31X having the plurality of bottomed holes 31*d* and the recess 32X having the plurality of bottomed holes 32*u* communicate with each other. On this occasion, in the accommodating portion 51 according to the present modification, the bottomed holes 31*d* of the recess 31X and the bottomed holes 32*u* of the recess 32X are disposed so as to overlap with each other in plan view.

An outer face of a reinforcing member 41 according to the present modification is formed into a shape extending along the inner faces of the recesses 31X and 32X. That is, the reinforcing member 41 according to the present modification is formed into a shape in which an end face 41A of the reinforcing member 41 has a curved face extending along the inner face of the recess 32X, and an end face 41B of the reinforcing member 41 has a curved face extending along the inner face of the recess 31X. For example, the end face 41A of the reinforcing member 41 is formed into a sectional shape in which a plurality of arc faces 41D are continuous to one another along the width direction of the liquid pipe 14. Each of the arc faces 41D is formed into a semielliptical arc shape that bulges toward the inner face of the recess 32X. The arc face 41D is, for example, formed into a convex shape that protrudes toward the inner face of the bottomed hole 32*u* of the recess 32X. In a similar manner or the same manner, the end face 41B of the reinforcing member 41 is, for example, formed into a sectional shape in which a plurality of arc faces 41U are continuous to one another along the width direction of the liquid pipe 14. Each of the arc faces 41U is formed so as to bulge toward the inner face of the recess 31X. The arc face 41U is, for example, formed into a convex shape that protrudes toward the inner face of the bottomed hole 31*d* of the recess 31X.

The reinforcing member 41 according to the present modification is disposed inside the accommodating portion 51 so that each of the arc faces 41D of the end face 41A contacts each of the inner faces of the bottomed holes 32*u*, and a gap S1 is formed between the end face 41B and the inner face of the recess 31X.

Incidentally, since the accommodating portion 52 and the reinforcing member 42 have structures similar to or the same as the accommodating portion 51 and the reinforcing member 41 respectively, description about the accommodating portion 52 and the reinforcing member 42 will be omitted here. Next, a method for manufacturing a loop heat pipe 10 according to the present modification will be described with reference to FIGS. 9A to 9D and FIG. 10.

Figure 9A:
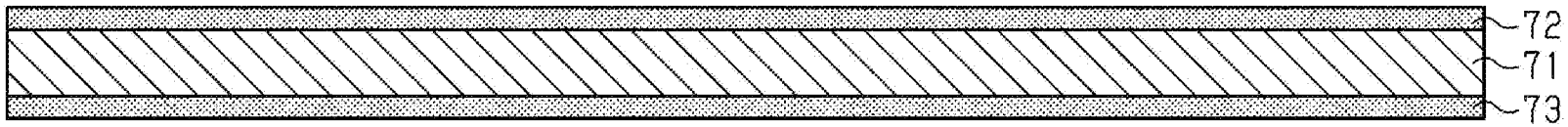
FIGS. 9A to 9D are schematic sectional views showing a method for manufacturing the loop heat pipe according to the modification.

First, in a step shown in FIG. 9A, a flat plate-like metal sheet 71 is prepared. The metal sheet 71 is a member that will finally serve as a metal layer 31 (see FIG. 8). The metal sheet 71 is, for example, made of copper, stainless steel, aluminum, a magnesium alloy, or the like. The metal sheet 71 can be, for example, made about 50 μm to 200 μm thick.

Subsequently, a resist layer 72 is formed on an upper face of the metal sheet 71, and a resist layer 73 is formed on a lower face of the metal sheet 71. As each of the resist layers 72 and 73, for example, a photosensitive dry film resist or the like can be used.

Figure 9B:
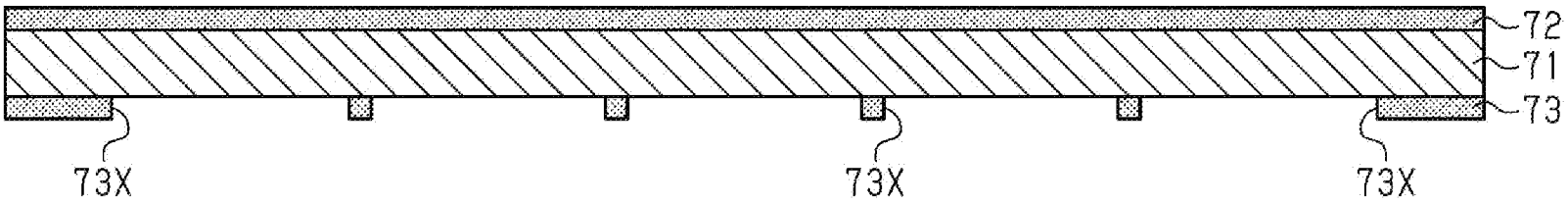

Next, in a step shown in FIG. 9B, the resist layer 73 is exposed to light and developed so that openings 73X that selectively expose the lower face of the metal sheet 71 are formed. The openings 73X are formed so as to correspond to a plurality of bottomed holes 31*d* shown in FIG. 8.

Figure 9C:
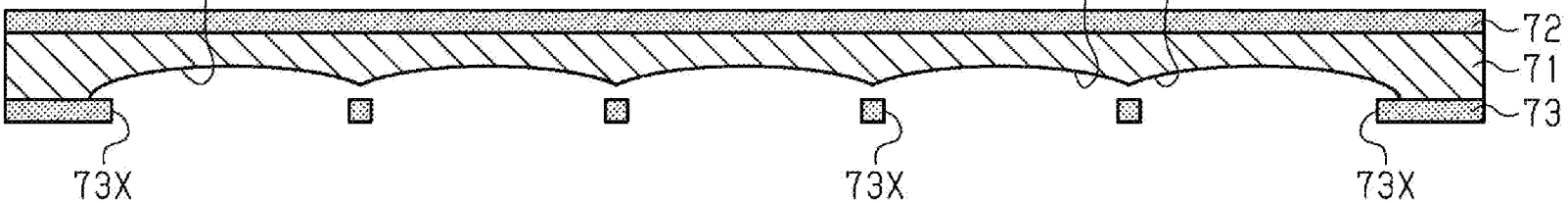

Next, in a step shown in FIG. 9C, the metal sheet 71 exposed in the openings 73X is etched from the lower face side of the metal sheet 71. As a result, a recess 31X having the plurality of bottomed holes 31*d* is formed in the lower face of the metal sheet 71. For example, a ferric chloride solution can be used for etching the metal sheet 71.

Figure 9D:
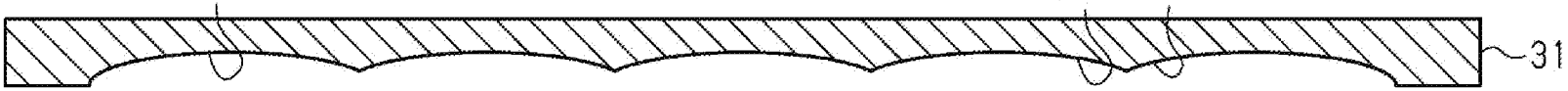

Subsequently, the resist layers 72 and 73 are stripped off by a stripping solution. As a result, the metal layer 31 having the recess 31X in its lower face can be formed, as shown in FIG. 9D. The recess 31X includes an inner face in which a plurality of semielliptical arcs are continuous to one another.

Figure 10:
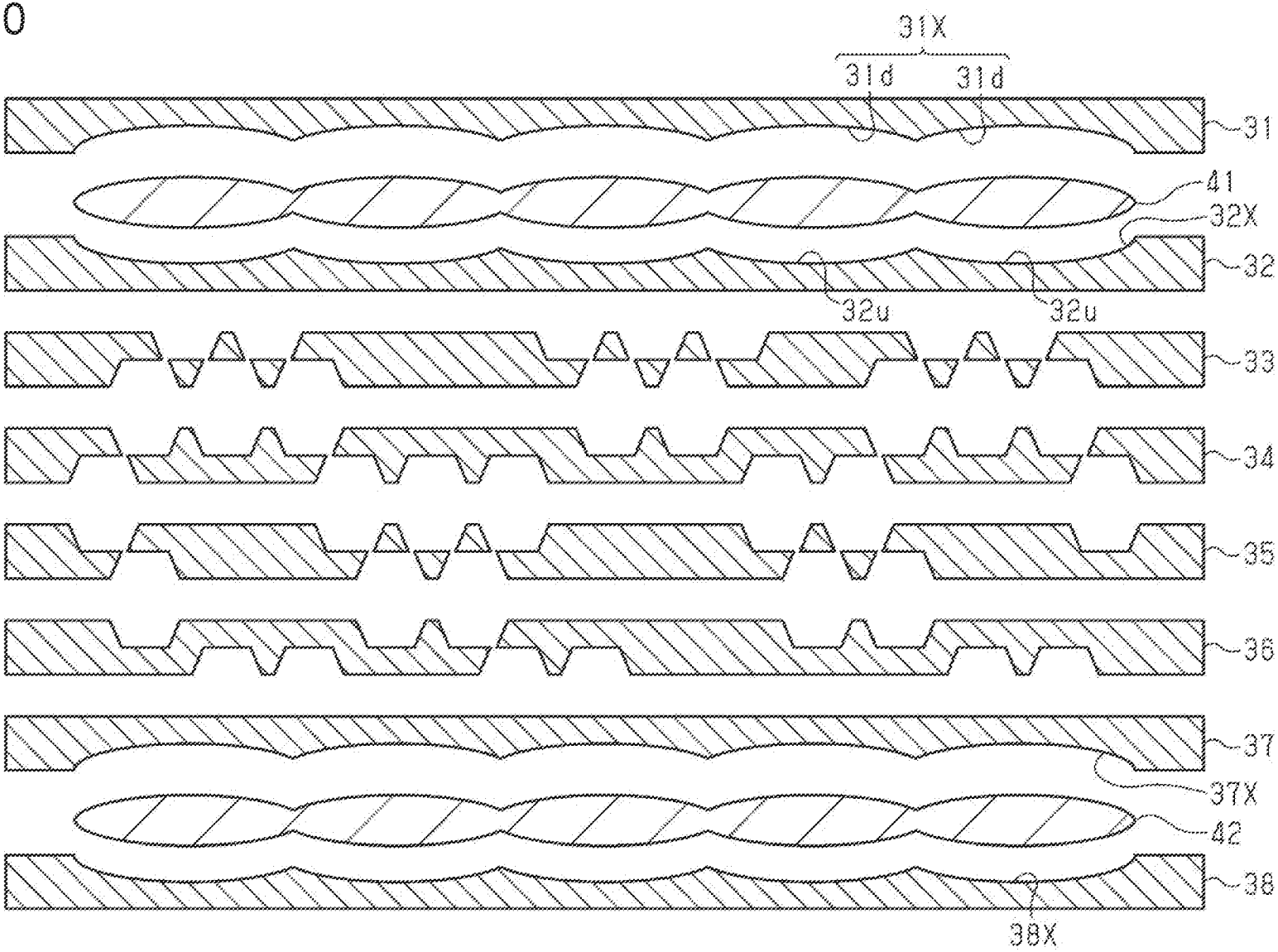
FIG. 10 is a schematic sectional view showing the method for manufacturing the loop heat pipe according to the modification.

Next, in a step shown in FIG. 10, metal layers 32, 37, and 38 are formed by a method similar to or the same as the steps shown in FIGS. 9A to 9D, and metal layers 34, 35, and 36 are formed by a method similar to or the same as the steps shown in FIGS. 5A to 5D. Further, a reinforcing member 41 having end faces 41A and 41B each formed into a shape in which arc faces 41D, 41U are continuous to one another is prepared, and a reinforcing member 42 having a structure similar to or the same as that of the reinforcing member 41 is prepared. Then, the metal layers 31 and 32 are disposed so as to sandwich the reinforcing member 41 therebetween, the metal layers 37 and 38 are disposed so as to sandwich the reinforcing member 42 therebetween, and the metal layers 33, 34, 35 and 36 are disposed between the metal layer 32 and the metal layer 37. On this occasion, the reinforcing member 41 is disposed at a position where it overlaps with the recesses 31X and 32X of the metal layers 31 and 32 in plan view, and the reinforcing member 42 is disposed at a position where it overlaps with recesses 37X and 38X of the metal layers 37 and 38 in plan view.

Next, the stacked metal layers 31 to 38 and the reinforcing members 41 and 42 are pressed while being heated at a predetermined temperature (e.g. about 900° C.). As a result, the metal layers 31 to 38 are bonded to one another by solid-phase bonding. By the aforementioned steps, a structure body shown in FIG. 8 can be manufactured, and the loop heat pipe 10 according to the present modification can be manufactured.

In the modification shown in FIG. 8, the number of the bottomed holes 31*d* in the recess 31X is not limited particularly. For example, the number of the bottomed holes 31*d* in the recess 31X may be 1 to 4 or may be 6 or more. In this case, it is preferable that the number of the arc faces 41U in the end face 41B of the reinforcing member 41 is also changed according to the number of the bottomed holes 31*d*.

In the modification shown in FIG. 8, the number of the bottomed holes 32*u* in the recess 32X is not limited particularly. For example, the number of the bottomed holes 32*u* in the recess 32X may be 1 to 4 or may be 6 or more. In this case, it is preferable that the number of the arc faces 41D in the end surface 41A of the reinforcing member 41 is also changed according to the number of the bottomed holes 32*u*.

In the modification shown in FIG. 8, the number of the bottomed holes 31*d* in the recess 31X and the number of the bottomed holes 32*u* in the recess 32X may be set to different numbers from each other. In the modification shown in FIG. 8, the number of the arc faces 41D in the end face 41A of the reinforcing member 41 and the number of the arc faces 41U in the end face 41B may be set to different numbers from each other.

In the modification shown in FIG. 8, each of the inner faces of the bottomed holes 31*d* and 32*u* is formed into a semielliptical shape in sectional view. However, the modification is not limited thereto. For example, each of the inner faces of the bottomed holes 31*d* and 32*u* may be formed into a semicircular shape in sectional view.

In the modification shown in FIG. 8, each of the arc faces 41U and 41D is formed into a semielliptical arc shape in sectional view. However, the modification is not limited thereto. For example, each of the arc faces 41U and 41D may be formed into a semicircular arc shape in sectional view.

In the aforementioned embodiment, each of the reinforcing members 41 and 42 is formed so as to extend continuously over the entire length of the flow channel 14*r* (the porous body 20 in this case) in the width direction of the liquid pipe 14. However, the aforementioned embodiment is not limited thereto.

Figure 11:
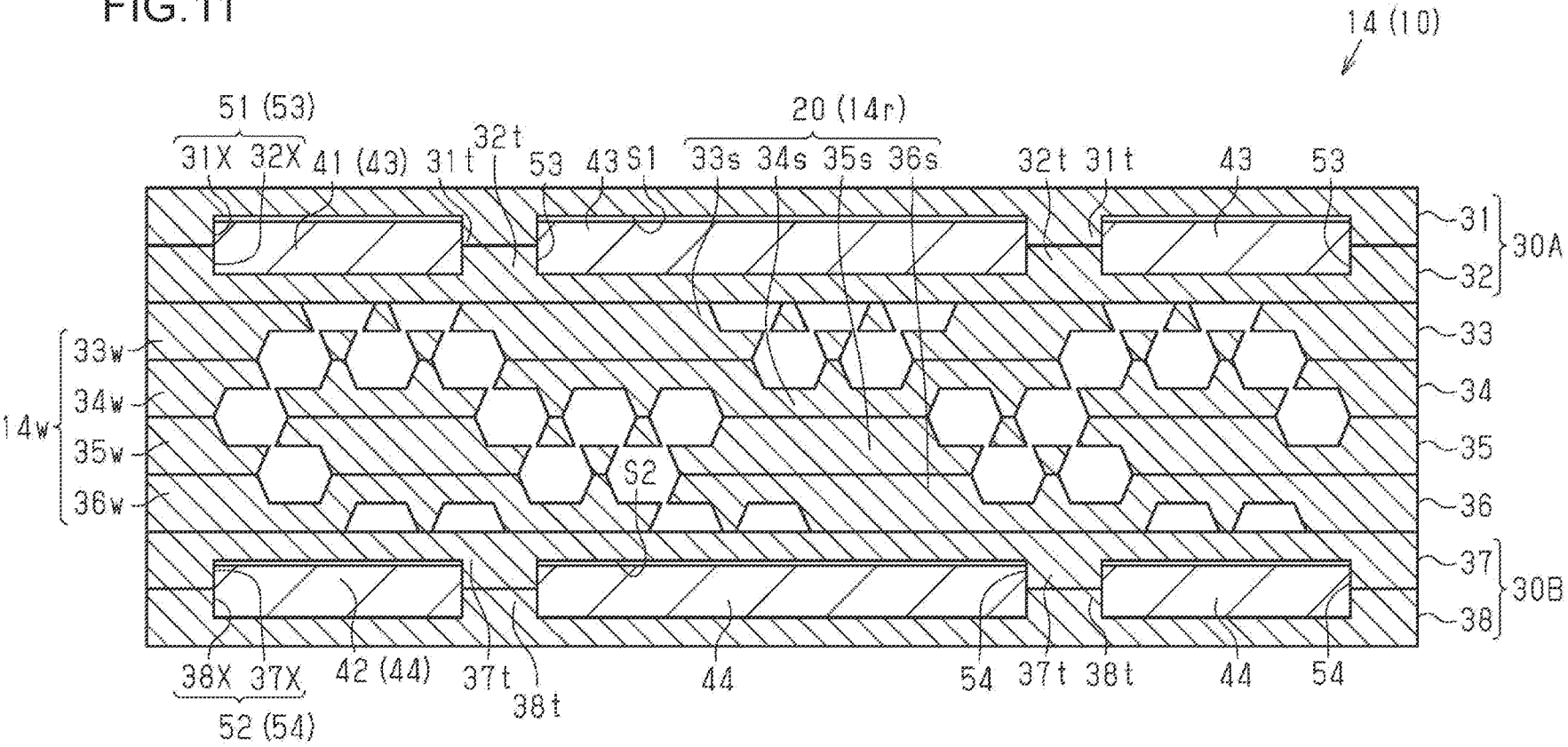
FIG. 11 is a schematic sectional view showing a loop heat pipe according to another modification.

For example, as shown in FIG. 11, each of reinforcing members 41 and 42 may be divided into a plurality of parts. In this case, each of accommodating portions 51 and 52 is divided into a plurality of parts according to the number of the divided parts of the reinforcing member 41, 42. The reinforcing member 41 according to the present modification has a plurality of (three in this case) divided reinforcing members 43. The accommodating portion 51 according to the present modification has a plurality of (three in this case) divided accommodating portions 53. The plurality of divided accommodating portions 53 are, for example, provided side by side along a width direction of a liquid pipe 14. The plurality of divided accommodating portions 53 are, for example, provided separately from one another in the width direction of the liquid pipe 14. In other words, each of metal layers 31 and 32 has compartment walls 31*t*, 32*t* each of which partitions two divided accommodating portions 53 adjacent to each other in the width direction of the liquid pipe 14. The compartment wall 31*t* and the compartment wall 32*t* are provided between the two divided accommodating portions 53 adjacent to each other in the width direction of the liquid pipe 14. The adjacent two divided accommodating portions 53 are, for example, completely divided by the compartment wall 31*t* and the compartment wall 32*t*. The plurality of divided reinforcing members 43 are individually accommodated in the plurality of divided accommodating portions 53 respectively. Upper faces of the divided reinforcing members 43 are flush with one another, and lower faces of the divided reinforcing members 43 are flush with one another.

In a similar manner or the same manner, the reinforcing member 42 according to the present modification has a plurality of (three in this case) divided reinforcing members 44. The accommodating portion 52 according to the present modification has a plurality of (three in this case) divided accommodating portions 54. The plurality of divided accommodating portions 54 are, for example, provided side by side along the width direction of the liquid pipe 14. The plurality of divided accommodating portions 54 are, for example, provided separately from one another in the width direction of the liquid pipe 14. In other words, each of the metal layers 37 and 38 has compartment walls 37*t*, 38*t* each of which partitions two divided accommodating portions 54 adjacent to each other in the width direction of the liquid pipe 14. The compartment wall 37*t* and the compartment wall 38*t* are provided between the two divided accommodating portions 54 adjacent to each other in the width direction of the liquid pipe 14. The adjacent two divided accommodating portions 54 are, for example, completely divided by the compartment wall 37*t* and the compartment wall 38*t*. The plurality of divided reinforcing members 44 are individually accommodated in the plurality of divided accommodating portions 54 respectively. Upper faces of the divided reinforcing members 44 are flush with one another, and lower faces of the divided reinforcing members 44 are flush with one another.

The configuration can also obtain functions and effects similar to or the same as those of the aforementioned embodiment. Further, in the aforementioned configuration, lower faces of the compartment walls 31*t* and upper faces of the compartment walls 32*t* are bonded to each other, and lower faces of the compartment walls 37*t* and upper faces of the compartment walls 38*t* are bonded to each other. Therefore, during solid-phase bonding, a contact area between the metal layers 31 and 32 can be increased due to the provision of the compartment walls 31*t* and 32*t*, and a contact area between the metal layers 37 and 38 can be increased due to the provision of the compartment walls 37*t* and 38*t*. Thus, pressure can be suitably applied to the metal layers 31 to 38 during the solid-phase bonding. As a result, the metal layers 31 to 38 can be suitably bonded to one another.

In the aforementioned embodiment, the reinforcing members 41 and 42 are formed so as to extend over the entire length of the flow channel 14*r* (the porous body 20 in this case) in the width direction of the liquid pipe 14. However, the aforementioned embodiment is not limited thereto. That is, the reinforcing members 41 and 42 are provided so as to overlap with the entire porous body 20 in plan view. However, the positions where the reinforcing members 41 and 42 are formed are not limited to the aforementioned positions.

Figure 12:
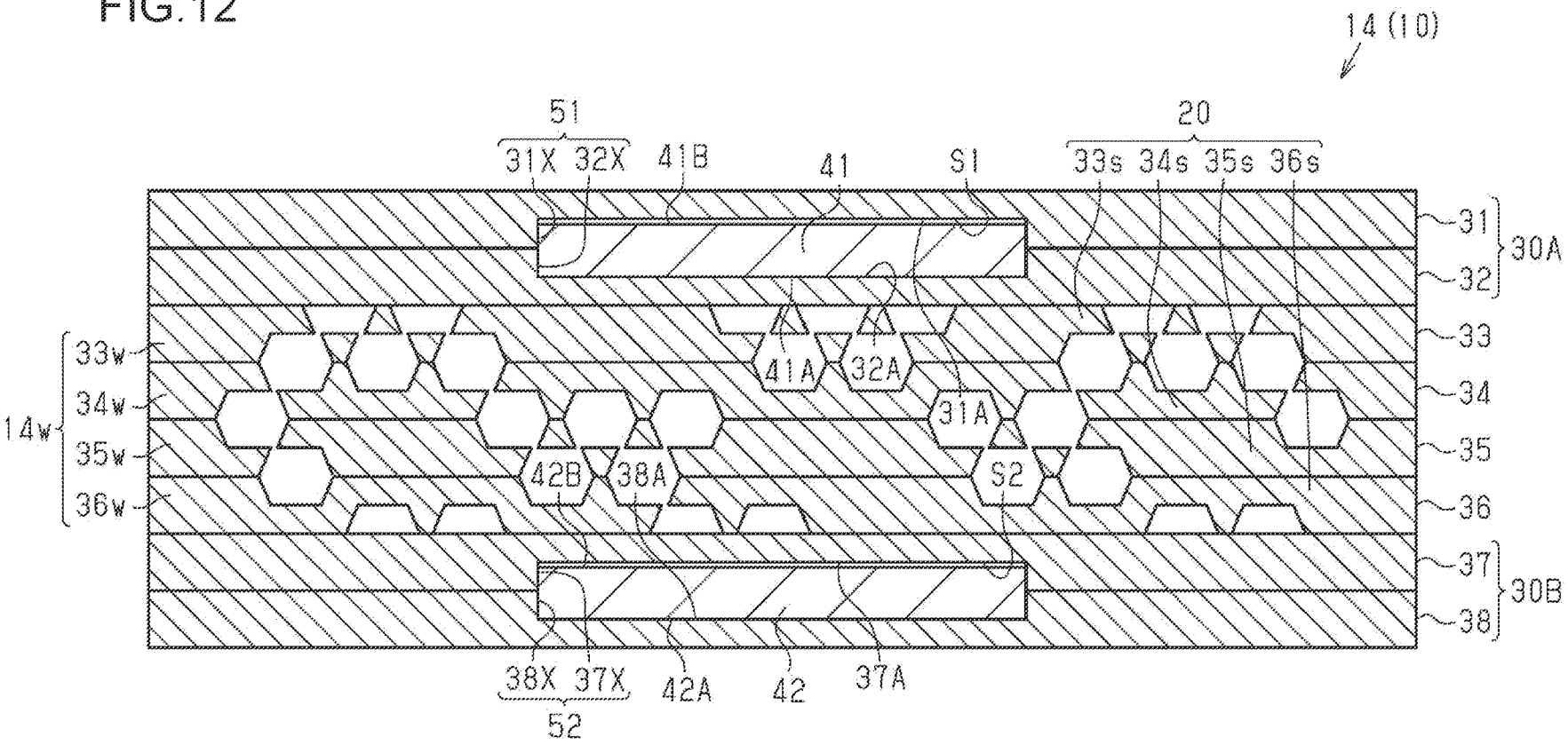
FIG. 12 is a schematic sectional view showing a loop heat pipe according to a further modification.

For example, as shown in FIG. 12, reinforcing members 41 and 42 may be provided so as to overlap with only a part of a flow channel 14*r* (a porous body 20 in this case) in plan view in a width direction of a liquid pipe 14. The reinforcing members 41 and 42 according to the present modification are provided so as to overlap with only a central portion of the flow channel 14*r* in plan view in the width direction of the liquid pipe 14. In this case, accommodating portions 51 and 52 are provided so as to overlap with only the central portion of the flow channel 14*r* in plan view in the width direction of the liquid pipe 14.

In the modification shown in FIG. 12, the positions of the reinforcing members 41 and 42 and the accommodating portions 51 and 52 in the width direction of the liquid pipe 14 can be changed to any positions. For example, pressure during solid-phase bonding may be insufficiently applied to the portions where the reinforcing members 41 and 42 are disposed. Therefore, the positions where the reinforcing members 41 and 42 are disposed are set so that the reinforcing members 41 and 42 are not disposed in portions where sufficient bonding is desired to be secured. Further, the reinforcing members 41 and 42 are, for example, disposed in the portions easily affected by volume expansion of a working fluid C.

Figure 13:
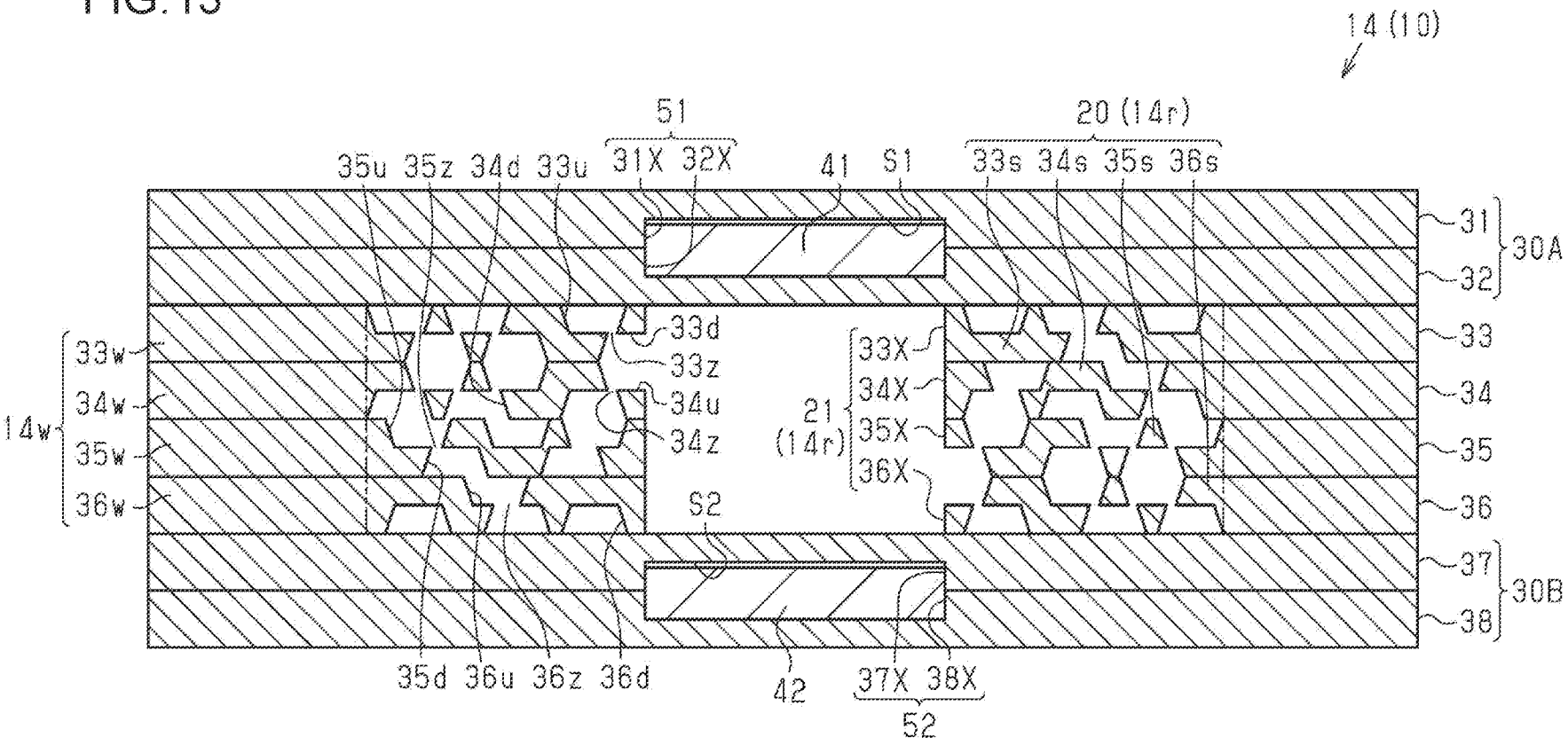
FIG. 13 is a schematic sectional view showing a loop heat pipe according to a further modification.

As shown in FIG. 13, porous bodies 20 and a flow channel 21 may be provided in a flow channel of a liquid pipe 14. The liquid pipe 14 according to the present modification has a pair of pipe walls 14*w*, the pair of porous bodies 20 formed continuously to the pair of pipe walls 14*w*, and the flow channel 21 provided between the pair of porous bodies 20. In the liquid pipe 14 according to the present modification, the flow channel 14*r* of the liquid pipe 14 is constituted by flow channels of the porous bodies 20 and the flow channel 21. Incidentally, each of the porous bodies 20 is constituted by porous bodies 33*s* to 36*s* of metal layers 33 to 36, which serve as intermediate metal layers, in a manner similar to or the same as in the aforementioned embodiment.

A sectional area of the flow channel 21 is, for example, formed to be larger than each of sectional areas of the flow channels of the porous bodies 20. The flow channel 21 is constituted by through holes 33X, 34X, 35X, and 36X that respectively thicknesswise penetrate the metal layers 33, 34, 35 and 36, that serve as the intermediate metal layers. The metal layers 33 to 36 are, for example, stacked on one another so that the through holes 33X to 36X overlap with one another in plan view. As a result, the through holes 33X to 36X communicate with one another, and the flow channel 21 is constituted by the through holes 33X to 36X. For example, the flow channel 21 communicates with the flow channels of the porous bodies 20. For example, the through hole 33X communicates with at least one of bottomed holes 33*u* and 33*d* of the metal layer 33. The through hole 34X communicates with at least one of bottomed holes 34*u* and 34*d* of the metal layer 34. The through hole 35X communicates with at least one of bottomed holes 35*u* and 35*d* of the metal layer 35. The through hole 36X communicates with at least one of bottomed holes 36*u* and 36*d* of the metal layer 36.

In the present modification, reinforcing members 41 and 42 may be provided so as to overlap with only the flow channel 21 among the porous bodies 20 and the flow channel 21 in plan view. In this case, accommodating portions 51 and 52 are provided so as to overlap with only the flow channel 21 in plan view.

Here, the amount of a working fluid C flowing inside the flow channel 21 is larger than the amount of a working fluid C flowing inside each of the flow paths of the porous bodies 20. Therefore, volume expansion of the working fluid C inside the flow path 21 increases. Thus, wall portions that partition the flow path 21 are susceptible to the volume expansion of the working fluid C. On the other hand, according to the aforementioned configuration, the reinforcing members 41 and 42 are provided at positions where they overlap with the flow channel 21 in plan view. That is, the reinforcing members 41 and 42 are provided in portions serving as the wall portions that partition the flow channel 21. Thus, of outer metal layers 30A and 30B, the portions that serve as the wall portions of the flow channel 21 can be improved in mechanical strength. Therefore, even in a case where, for example, volume expansion occurs due to a liquid-to-solid phase change of the working fluid C flowing inside the flow channel 21, the outer metal layers 30A and 30B can be suppressed from being deformed.

In the aforementioned embodiment, the reinforcing member 41 is accommodated in the accommodating portion 51 so that the gap S1 is formed between the end face 41B and the inner face of the accommodating portion 51. However, the aforementioned embodiment is not limited thereto. For example, the reinforcing member 41 may be accommodated in the accommodating portion 51 so that the end face 41B and the inner face of the accommodating portion 51 are brought into contact with each other.

In the aforementioned embodiment, the reinforcing member 42 is accommodated in the accommodating portion 52 so that the gap S2 is formed between the end face 42B and the inner face of the accommodating portion 52. However, the aforementioned embodiment is not limited thereto. For example, the reinforcing member 42 may be accommodated in the accommodating portion 52 so that the end face 42B and the inner face of the accommodating portion 52 are brought into contact with each other.

In the aforementioned embodiment, the accommodating portion 51 is constituted by the recess 31X of the metal layer 31 and the recess 32X of the metal layer 32. However, the aforementioned embodiment is not limited thereto. For example, the accommodating portion 51 may be constituted by only the recess 31X. For example, the accommodating portion 51 may be constituted by only the recess 32X.

In the aforementioned embodiment, the accommodating portion 52 is constituted by the recess 37X of the metal layer 37 and the recess 38X of the metal layer 38. However, the aforementioned embodiment is not limited thereto. For example, the accommodating portion 52 may be constituted by only the recess 37X. For example, the accommodating portion 52 may be constituted by only the recess 38X.

In the aforementioned embodiment, the reinforcing members 41 and 42 are formed into the same shape. However, the aforementioned embodiment is not limited thereto. For example, the reinforcing members 41 and 42 may be formed into different shapes from each other. In this case, the shapes of the accommodating portions 51 and 52 are also changed in accordance with the shapes of the reinforcing members 41 and 42.

In the liquid pipe 14 according to the aforementioned embodiment, the reinforcing members 41 and 42 are provided so as to extend over the entire lengthwise length of the liquid pipe 14. However, the aforementioned embodiment is not limited thereto. For example, in the liquid pipe 14, the reinforcing members 41 and 42 may be provided only in lengthwise portions of the liquid pipe 14. In a similar manner or the same manner, in the evaporator 11, the reinforcing members 41 and 42 may be provided only in lengthwise portions of the evaporator 11. Further, in the vapor pipe 12, the reinforcing members 41 and 42 may be provided only in lengthwise portions of the vapor pipe 12. Further, in the condenser 13, the reinforcing members 41 and 42 may be provided only in lengthwise portions of the condenser 13.

In the aforementioned embodiment, the reinforcing members 41 and 42 are provided in each of the structure bodies of the evaporator 11, the vapor pipe 12, the condenser 13, and the liquid pipe 14. However, the aforementioned embodiment is not limited thereto. For example, the reinforcing members 41 and 42 may be provided in at least one of the structure bodies of the evaporator 11, the vapor pipe 12, the condenser 13, and the liquid pipe 14. For example, the reinforcing members 41 and 42 may be provided only in the liquid pipe 14. For example, the reinforcing members 41 and 42 may be provided only in the vapor pipe 12. In this case, the reinforcing members 41 and 42 are, for example, provided to overlap with the flow channel 12*r* in plan view.

In the aforementioned embodiment, one of the reinforcing members 41 and 42 may be omitted. The shapes of the bottomed holes 33*u* to 36*u* and 33*d* to 36*d* in the porous body 20 according to the aforementioned embodiment may be appropriately changed.

In the porous body 20 according to the aforementioned embodiment, depth of the bottomed holes 33*u* to 36*u* on the upper face side and depth of the bottomed holes 33*d* to 36*d* on the lower face side may be different from each other. The porous body 20 according to the aforementioned embodiment has a structure including the metal layers each of which has the first bottomed holes recessed from the upper face side, the second bottomed holes recessed from the lower face side, and the pores formed by the first bottomed holes and the second bottomed holes partially communicating with each other. However, the aforementioned embodiment is not limited thereto. For example, the porous body 20 may have a configuration in which first metal layers each including first through holes penetrating the first metal layer in the thickness direction and second metal layers each including second through holes penetrating the second metal layer in the thickness direction are provided so that the first metal layers and the second metal layers are stacked on each other so as to partially overlap the first through holes with the second through holes. In this case, pores communicating with one another are formed at portions where the first through holes and the second through holes partially overlap with each other.

The porous body 20 may be omitted from the liquid pipe 14 according to the aforementioned embodiment. In this case, for example, the flow channel 14*r* (e.g. the flow channel 21 shown in FIG. 13) is formed between the pair of pipe walls 14*w*.

Although the preferred embodiments etc. have been described in detail, the concept of the disclosure is not limited to the above-described embodiments etc. and various modifications and replacements can be made in the above-described embodiments etc. without departing from the scope of the claims.

What is claimed is:

1. A loop heat pipe comprising:

an evaporator configured to vaporize a working fluid;

a condenser configured to condense the working fluid;

a liquid pipe that connects the evaporator and the condenser to each other; and a vapor pipe that connects the evaporator and the condenser to each other so as to form a loop together with the liquid pipe, wherein each of the evaporator, the condenser, the liquid pipe and the vapor pipe comprises:

a first outer metal layer and a second outer metal layer;

an intermediate metal layer provided between the first outer metal layer and the second outer metal layer; and a flow channel that is defined by the first outer metal layer, the second outer metal layer, and the intermediate metal layer and through which the working fluid flows, at least one of the evaporator, the condenser, the liquid pipe and the vapor pipe further comprises:

a reinforcing member that is built in at least one of the first outer metal layer and the second outer metal layer, the reinforcing member being higher in rigidity than the first outer metal layer and the second outer metal layer, an accommodating portion configured to accommodate the reinforcing member is formed in the at least one of the first outer metal layer and the second outer metal layer where the reinforcing member is built, the reinforcing member and the flow channel face each other, and are separated from each other in a thickness direction of the loop heat pipe, the reinforcing member comprises a first end face, and a second end face opposite to the first end face, the first end face of the reinforcing member contacts an inner face of the accommodating portion, and a gap is provided between the second end face of the reinforcing member and the inner face of the accommodating portion so that an entirety of the second end face of the reinforcing member is spaced from the inner face of the accommodating portion by the gap.

2. The loop heat pipe according to claim 1, wherein the first end face is located at a position lower than the second end face in the thickness direction of the loop heat pipe.

3. The loop heat pipe according to claim 1, wherein the reinforcing member has divided reinforcing members that are separated from one another;

divided accommodating portions are formed in the at least one of the first outer metal layer and the second outer metal layer where the divided reinforcing members are built, and each of the divided accommodating portions is configured to accommodate a corresponding one of the divided reinforcing members.

4. The loop heat pipe according to claim 3, wherein the divided reinforcing members are aligned in a width direction of the loop heat pipe orthogonal to the thickness direction of the loop heat pipe.

5. The loop heat pipe according to claim 4, wherein each of the divided reinforcing members comprises a first end face, and a second end face opposite to the first end face, the first end faces of the divided reinforcing members are flush with one another, and the second end faces of the divided reinforcing members are flush with one another.

6. The loop heat pipe according to claim 1, wherein the at least one of the first outer metal layer and the second outer metal layer where the reinforcing member is built comprises:

a first metal layer having a first recess; and a second metal layer having a second recess, and disposed on the first metal layer such that the second recess faces the first recess, and the accommodating portion is configured by the first recess and the second recess.

7. The loop heat pipe according to claim 1, wherein the reinforcing member is built in each of the first outer metal layer and the second outer metal layer.

8. The loop heat pipe according to claim 1, wherein the liquid pipe comprises the reinforcing member, the flow channel of the liquid pipe has a porous body, and the reinforcing member and the porous body face each other and are separated from each other in the thickness direction of the loop heat pipe.

9. The loop heat pipe according to claim 1, wherein the liquid pipe comprises the reinforcing member, the flow channel of the liquid pipe has a pair of porous bodies, and a first flow channel that is provided between the pair of porous bodies, and the reinforcing member and the first flow channel face each other and are separated from each other in the thickness direction of the loop heat pipe.

10. The loop heat pipe according to claim 9, wherein the reinforcing member does not face the pair of porous bodies in the thickness direction of the loop heat pipe.

11. The loop heat pipe according to claim 1, wherein the reinforcing member is formed into a flat plate shape.

* * * * *